US012227960B1

(12) United States Patent
Bishop

(10) Patent No.: US 12,227,960 B1
(45) Date of Patent: Feb. 18, 2025

(54) POST AND GROUND MAT

(71) Applicant: Ameristar Perimeter Security USA Inc., Tulsa, OK (US)

(72) Inventor: Michael L. Bishop, Bristow, OK (US)

(73) Assignee: Ameristar Perimeter Security USA Inc., Tulsa, OK (US)

( * ) Notice: Subject to any disclaimer, the term of this patent is extended or adjusted under 35 U.S.C. 154(b) by 186 days.

(21) Appl. No.: 17/590,962

(22) Filed: Feb. 2, 2022

(51) Int. Cl.
*E04H 17/18* (2006.01)
*E04H 17/20* (2006.01)

(52) U.S. Cl.
CPC ..... *E04H 17/18* (2013.01); *E04H 17/21* (2021.01)

(58) Field of Classification Search
CPC ..... E04H 17/21; E04H 17/22
See application file for complete search history.

(56) References Cited

U.S. PATENT DOCUMENTS 632,966 A * 9/1899 Mullenix ..... E02D 5/80 52/156
4,718,624 A * 1/1988 Greulich ..... H04R 1/08 248/291.1
5,048,789 A * 9/1991 Eason ..... F16M 11/10 248/188.7
6,682,055 B1 * 1/2004 Tomlinson ..... E01F 13/022 248/129
6,845,970 B1 * 1/2005 Kenton ..... E04G 21/3233 256/73
8,196,874 B2 * 6/2012 Zitting ..... F16M 11/42 248/129
D743,951 S * 11/2015 Slaton ..... D14/229
9,737,654 B2 * 8/2017 Walther ..... F16M 11/42
10,060,571 B2 * 8/2018 Koehler ..... F16M 11/42
11,813,425 B2 * 11/2023 Walther ..... A61M 5/1415
11,946,591 B2 * 4/2024 Huang ..... H04R 1/02
11,993,946 B2 * 5/2024 Miller ..... E04H 12/2253
2006/0053725 A1 * 3/2006 Su ..... B62B 3/02 52/590.1
2016/0270530 A1 * 9/2016 Heyring ..... F16M 11/22
2023/0203835 A1 * 6/2023 Vadas ..... E01F 9/692 256/25

FOREIGN PATENT DOCUMENTS

EP 0462818 A1 * 12/1991 ..... E01F 9/692
GB 2294488 A * 5/1996 ..... E01F 13/02
GB 2571771 A 9/2019
GB 2601237 A 5/2022

* cited by examiner

*Primary Examiner* — Matthew R McMahon
(74) *Attorney, Agent, or Firm* — Gary Peterson

(57) ABSTRACT

A post has an elongate shaft and a flat base. The base has the general shape of a non-rectangular parallelogram from which scoops and scallops have been excised. Excisions include a set of aligned scallops from each of two opposed first sides, and a single scoop from each of two opposed second sides. The shape of the bases permits the posts to be interlocked and stacked. The upper end of the shaft of one stacked post is cradled by the scoop of an adjacent post. The scallops of posts at one level of a stack cradle the shafts of posts stacked at a higher level. The effective surface area of the base may be increased with a flat ground mat that interlocks with the base. The posts, with or without ground mats, may be assembled with sheets of infill material to form a barrier, such as a temporary fence.

23 Claims, 27 Drawing Sheets

POST AND GROUND MAT

SUMMARY OF THE INVENTION

A post is formed from an elongate and rectilinear shaft and a flat base. The base is supported at the lower end of the shaft and extends in orthogonal relationship thereto. The base has a centroid and an external profile that include two sets of aligned scallops and two concave scoops. The sets of scallops and the scoops each have point symmetry relative to the centroid.

A kit is formed from a plurality of posts and a plurality of ground mats. Each post is formed from an elongate and rectilinear shaft and a flat base supported by the lower end of the shaft. The base extends in orthogonal relationship to the shaft. Each ground mat has flat and opposed upper and lower sides and a surface area greater than that of the base of any of the posts. A spaced pair of hooks are supported on the upper side of each ground mat. The hooks bound opposed edges of a slotlike opening within which the base of one of the posts is extendable.

BRIEF DESCRIPTION OF THE DRAWINGS

FIG. 8 is an exploded perspective view showing how the shaft of FIG. 5 is assembled with the base of FIG. 6 to form the post of FIG. 1.

FIG. 9 is a front elevation view of a portion of a barrier that includes two of the posts of FIG. 1.

FIG. 13 is a front elevation view of a framework formed from a plurality of the posts of FIG. 1.

FIG. 18 is a top plan view of the assembly of FIG. 17, taken along line 18-18.

FIG. 19 is a front elevation view of six of the posts of FIG. 1, assembled into interlocking relationship. Two posts have been added on the lowermost level to the assembly of FIG. 17.

FIG. 23 is a top plan view of the ground mat of FIG. 22.

FIG. 24 is a front elevation view of the ground mat of FIG. 23, taken along line 24-24.

FIG. 26 is an exploded perspective view showing how two ground mats are nested together.

FIGS. 28 and 29 show successive stages of the assembly of the post of FIG. 1 with the ground mat of FIG. 23.

DETAILED DESCRIPTION

Figure 1:
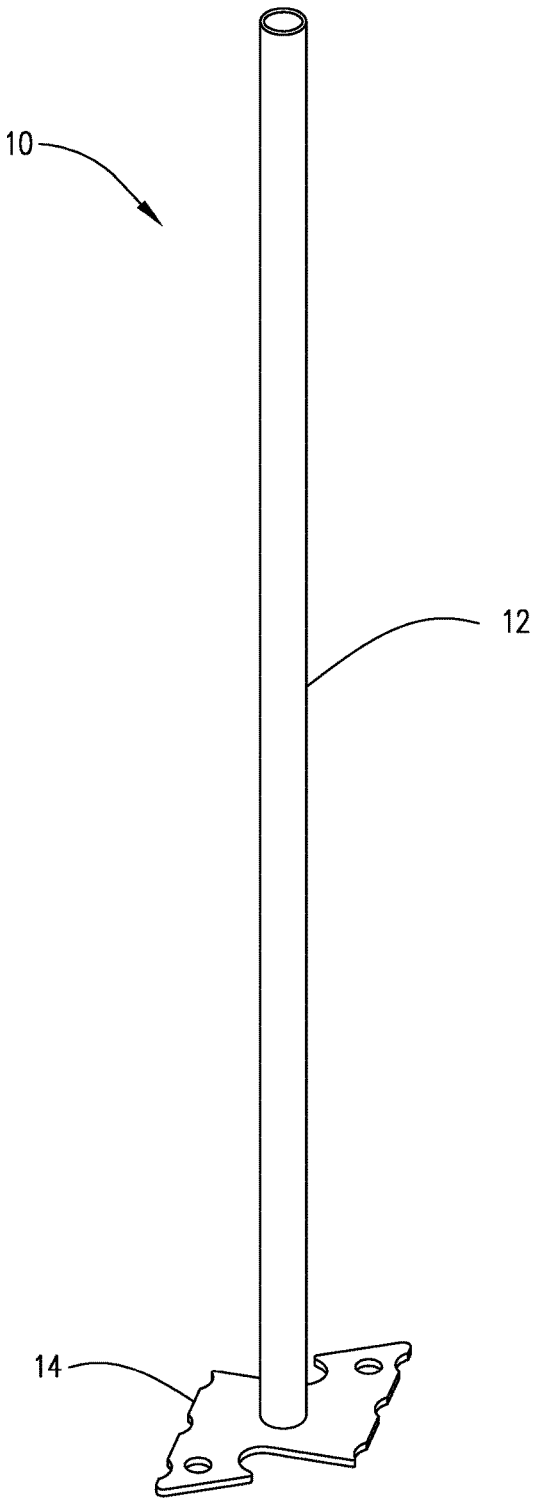
FIG. 1 is a perspective view of a post.
Figure 2:
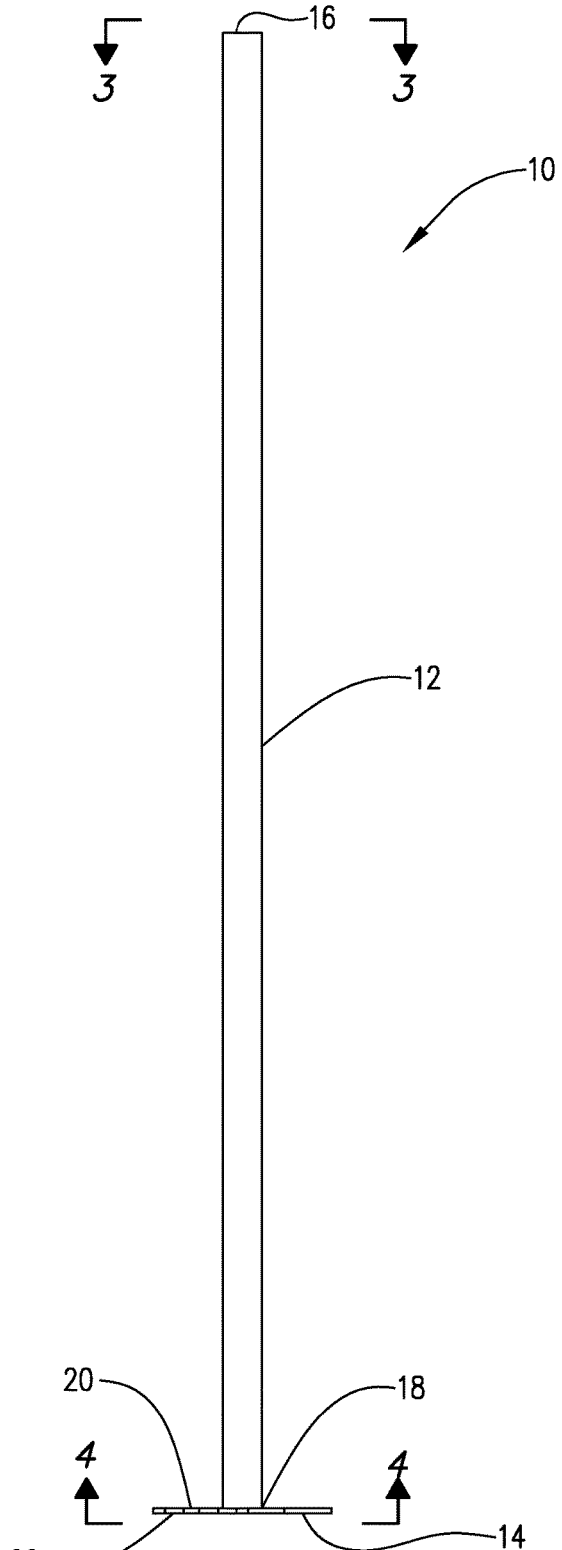
FIG. 2 is a front elevation view of the post of FIG. 1.
Figure 4:
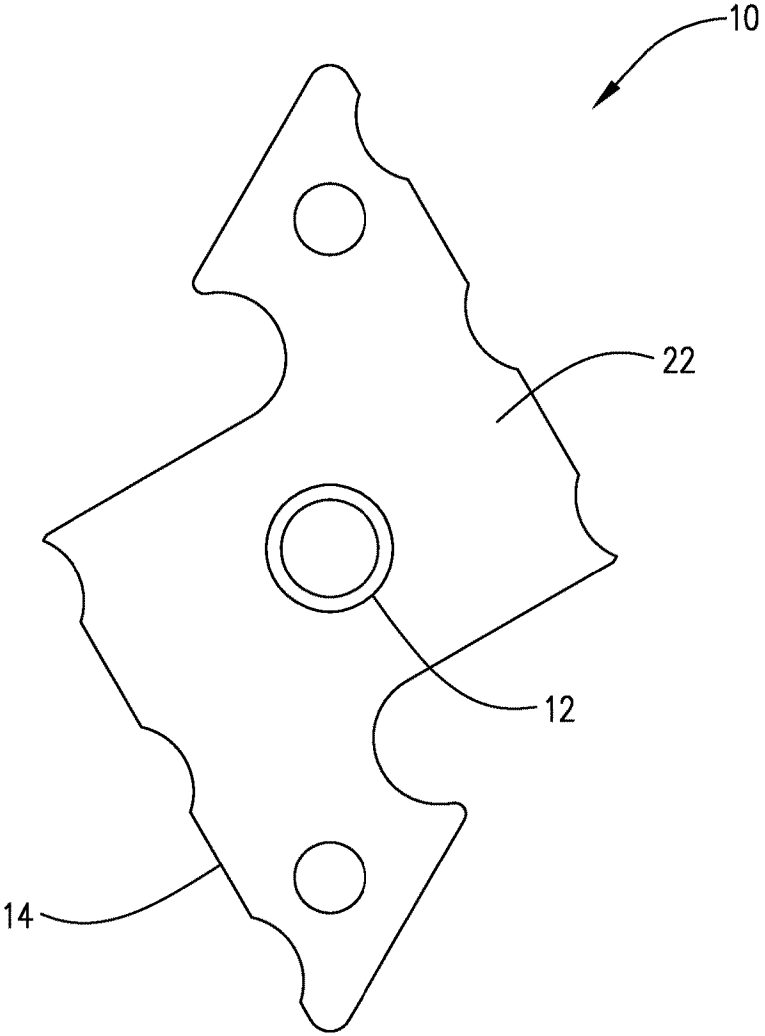
FIG. 4 is a bottom plan view of the post of FIG. 2, taken along line 4-4.
Figure 3:
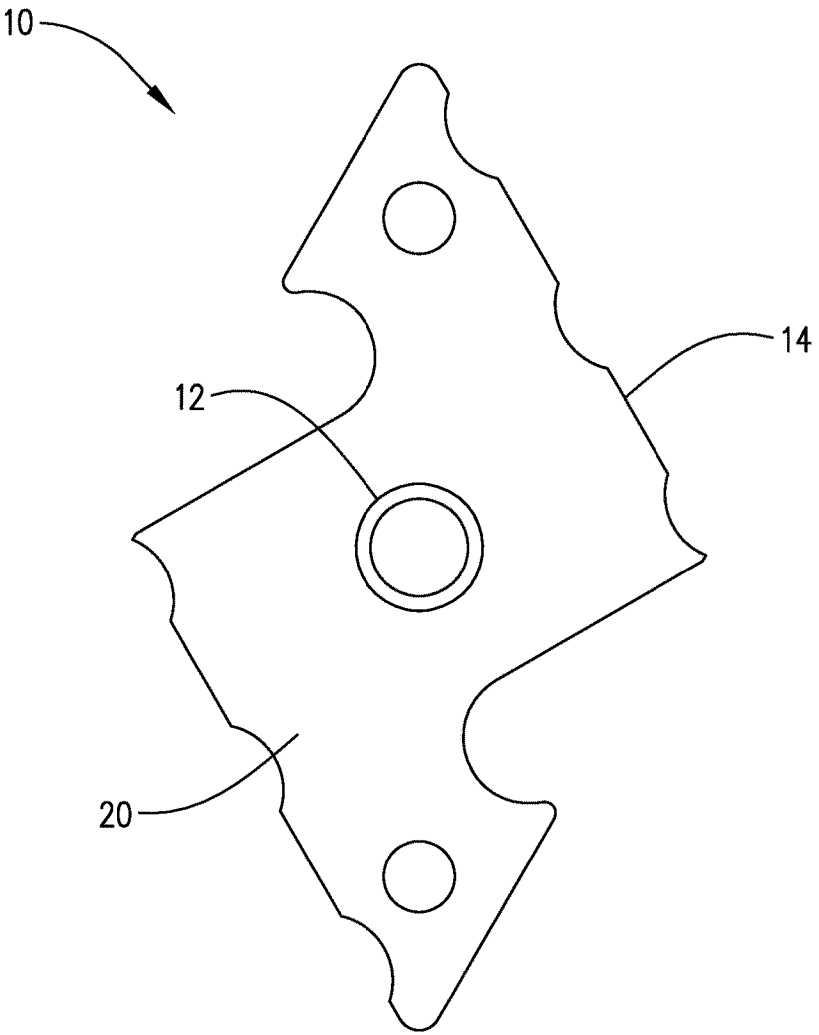
FIG. 3 is a top plan view of the post of FIG. 2, taken along line 3-3.
Figure 5:
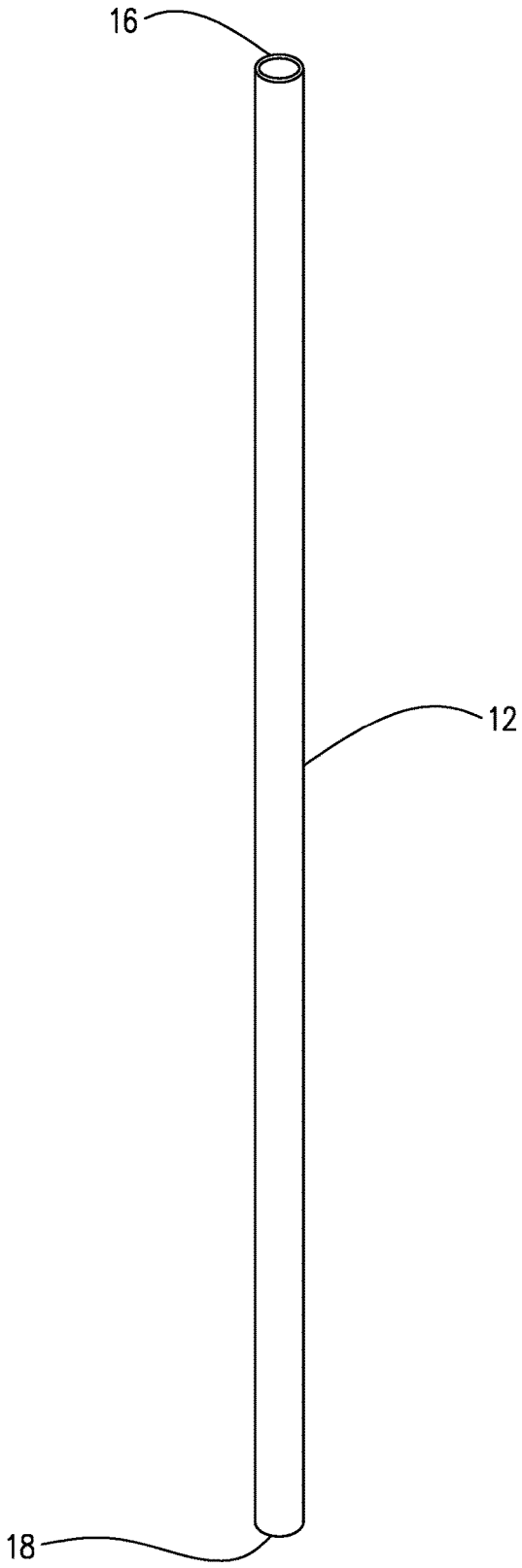
FIG. 5 is a perspective view of a shaft.

A post 10, shown in FIGS. 1-4, is formed from a shaft 12 and a base 14. The shaft 12, best shown in FIG. 5, is an elongate and rectilinear structure having an upper end 16 and an opposed lower end 18. The shaft 12 is preferably hollow and open-ended at its lower end 18, and more preferably is a hollow and tubular structure for the entirety of its length. The shaft 12 is preferably characterized by a circular external profile.

Figure 6:
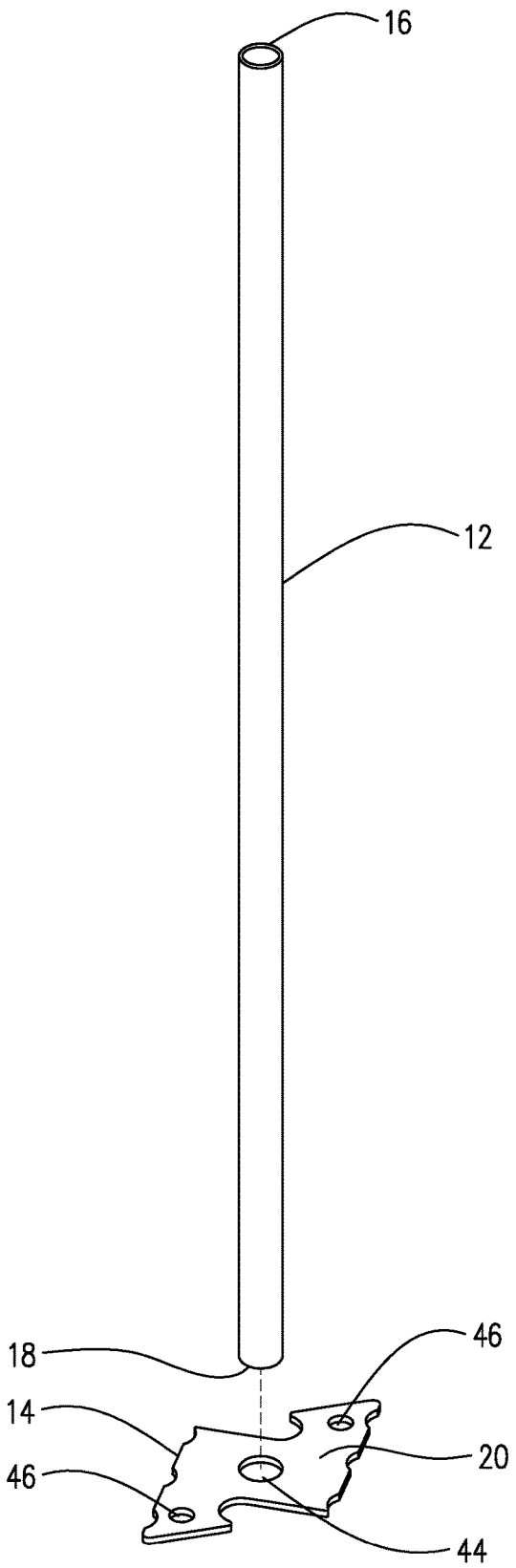
FIG. 6 is a perspective view of a base.
Figure 3:
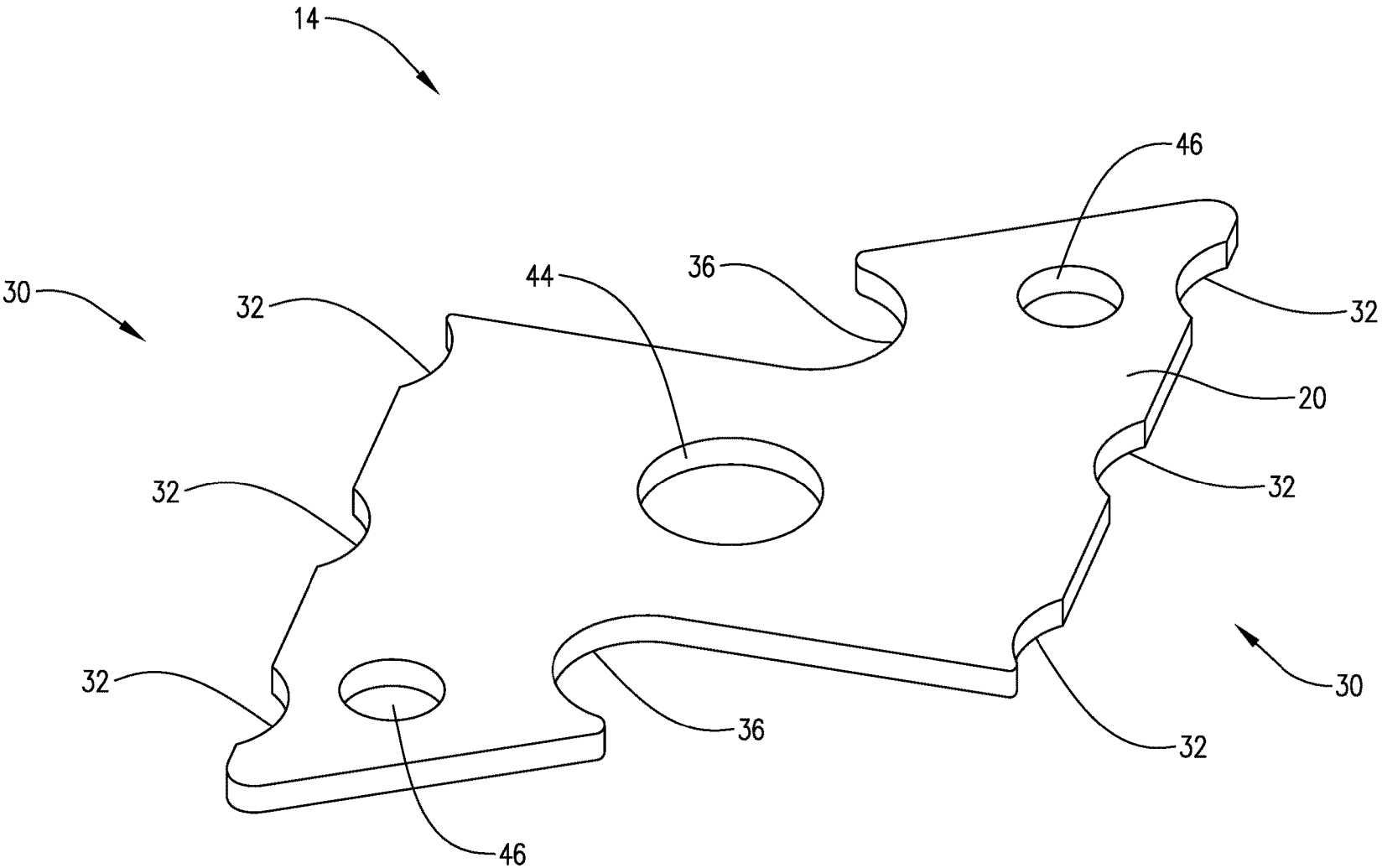
Figure 7:
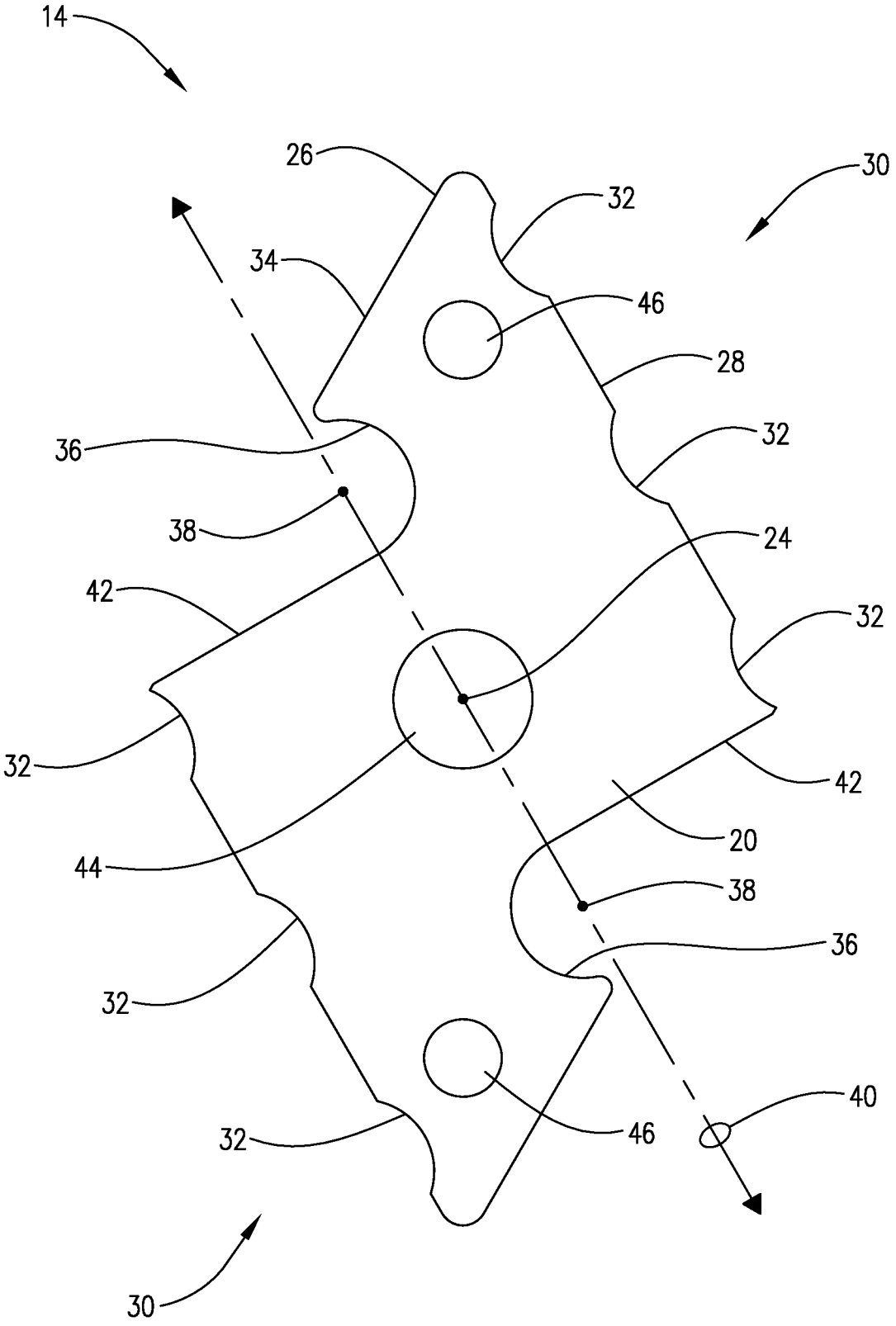
FIG. 7 is a top plan view of the base of FIG. 6.
Figure 3:
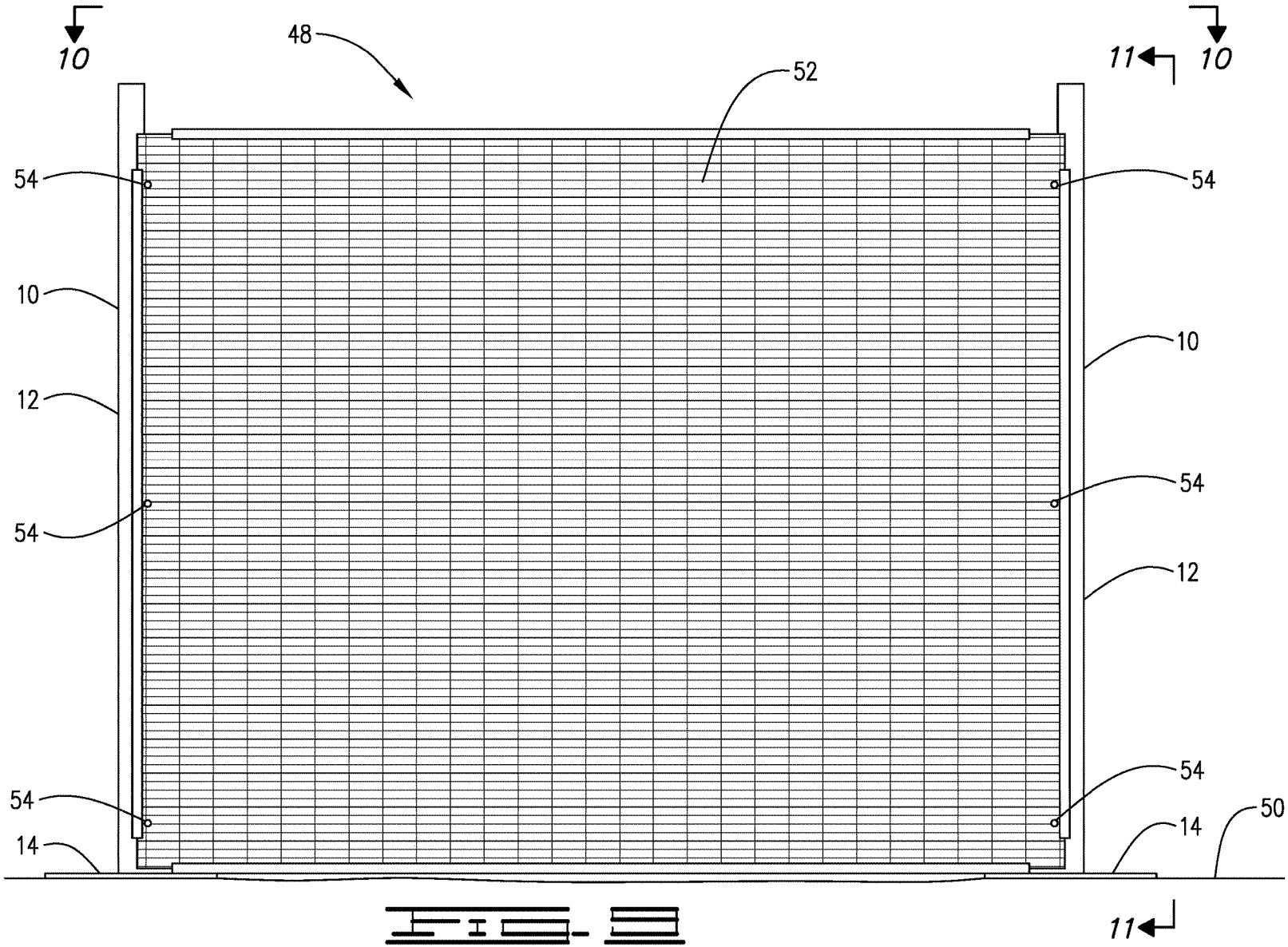

The base 14, shown in FIGS. 6 and 7, is a flat plate-like member having an upper side 20, a parallel and opposed lower side 22, and a centroid 24. The base 14 has an external profile 26 of irregular, but symmetrical, shape. The general shape of the profile 26 is preferably that of a non-rectangular parallelogram from which various scallops and scoops have been excised, as described hereafter. More preferably, the sides of that parallelogram are of equal length.

Comprising the profile 26 are a pair of spaced, parallel, rectilinear and longitudinally offset first sides 28. Excised from each first side 28 is a set 30 of aligned scallops 32. The scallops 32 are distributed to each set in an equal number. More preferably, the number of scallops 32 in each set 30 is three. The two sets 30 have point symmetry, sometimes called inversion symmetry, relative to the centroid 24.

Preferably, each scallop 32 is a continuous curve having a concave shape, which is more preferably a circular arc. Each scallop 32 is sized and shaped to cradle the shaft 12. If the scallops 32 are shaped as circular arcs, the radii of the scallops 32 in a set 30 are preferably identical. However, the scallops 32 themselves are not necessarily identical in shape. As shown in the Figures, one or more of the scallops 32 in a set 30 may be truncated at an edge of the base 14.

Preferably, the arc formed by each scallop 32 has a radius substantially equal to the radius of the circular profile of the shaft 12. More specifically, the radius of the arc should be at least as great as, and preferably slightly greater than, the radius of the circular profile of the shaft 12. An example of "substantially equal" radii in one embodiment is provided hereafter.

Further comprising the profile 26 are a pair of spaced, parallel and rectilinear second sides 34. Excised from each second side 34 is a scoop 36. Like the sets 30, the two scoops 36 have point symmetry relative to the centroid 24. Preferably, each scoop 36 is a continuous curve having a concave shape, which is more preferably a circular arc, and is sized and shaped to cradle the shaft 12.

Preferably, the arc formed by each scoop 36 has a radius substantially equal to the radius of the circular profile of the shaft 12. By "substantially equal" is meant the radius of the arc should be at least as great as, and preferably slightly greater than, the radius of the circular profile of the shaft 12. An example of "substantially equal" radii in one embodiment is provided hereafter. Also preferably, the scoops 36 have the same radius as the scallops 32.

The scoops 36 open in opposite directions, one toward each set 30 of scallops 32. Each scoop 36 has a center of curvature 38. The imaginary line 40 joining the centers of curvature 38 extends between, and is parallel to, the first sides 28. Each scoop 36 is joined to the adjacent first side 28 by a rectilinear segment 42. The segments 42 associated with the two scoops 36 extend in parallel relationship.

A shaft opening 44 is formed in the base 14 away from the edges thereof. The shaft opening 44 joins the two sides 20 and 22, is shaped and sized to closely receive the shaft 12, and has point symmetry relative to the centroid 24. Preferably, the centroid 24 is situated within the shaft opening 44. If the shaft opening 44 has the shape of a circle, as is preferred, the centroid 24 coincides with the center of that circle. Two anchor openings 46 are preferably formed in the base 14 on opposite sides of the shaft opening 44.

Preferably, the entirety of the external profile 26, and not just the sets 30, the scoops 36, and the shaft opening 44, has point symmetry relative to the centroid 24.

Assembly of the shaft 12 and the base 14 is shown in FIG. 8. From above the upper side 20 of the base 14, the lower end 18 of the shaft 12 is inserted into the shaft opening 44 until the lower end 18 and lower side 22 are coplanar. Thus configured, the shaft 12 and base 14 are permanently secured together, preferably by welding. Once installed, the base 14 extends in orthogonal relationship to the shaft 12.

In one embodiment, the shaft 12 is a cylindrical tube with a length of 108.1975 inches and an external radius of 1.4375 inches. The base 14 is 0.375 inches thick, and has a maximum length of 22 inches, measured along a line joining the shaft opening 44 and the anchor openings 46. The maximum width of the base 14, measured along a perpendicular to the foregoing line, is 13.0625 inches.

In the same embodiment, imaginary lines coinciding with each of the first sides 28 and second sides 34 form a parallelogram with four sides of equal length. The separation distance between opposed sides is 11.5 inches. Two opposed corners of that parallelogram subtend internal angles of 60 degrees. The two first sides 28 are longitudinally offset by 5.75 inches.

In the same embodiment, the number of scallops 32 in each set 30 is three. The center-to-center separation distance between adjacent scallops 32 of a set 30 is 5 inches. Each scallop 32 and each scoop 36 is a continuous curve having the shape of a circular arc with a radius of 1.5 inches, which is deemed substantially equal to the shaft radius of 1.4375 inches. Each scallop 32 has a maximum depth of 0.5 inches below the first side 28.

In the same embodiment, the shaft opening 44 is a circle with a radius of 1.455 inches. Each anchor opening 46 is a circle with a radius of 0.815 inches.

Components of the post 10, including the shaft 12 and base 14, are preferably formed from a strong and durable material, such as steel. Because the posts 10 may be used outdoors, the steel used to form post components is preferably pre-galvanized, in order to enhance its resistance to corrosion. After a component has been fabricated, a polyester powder coating may also be applied, to further enhance corrosion resistance.

Figure 10:
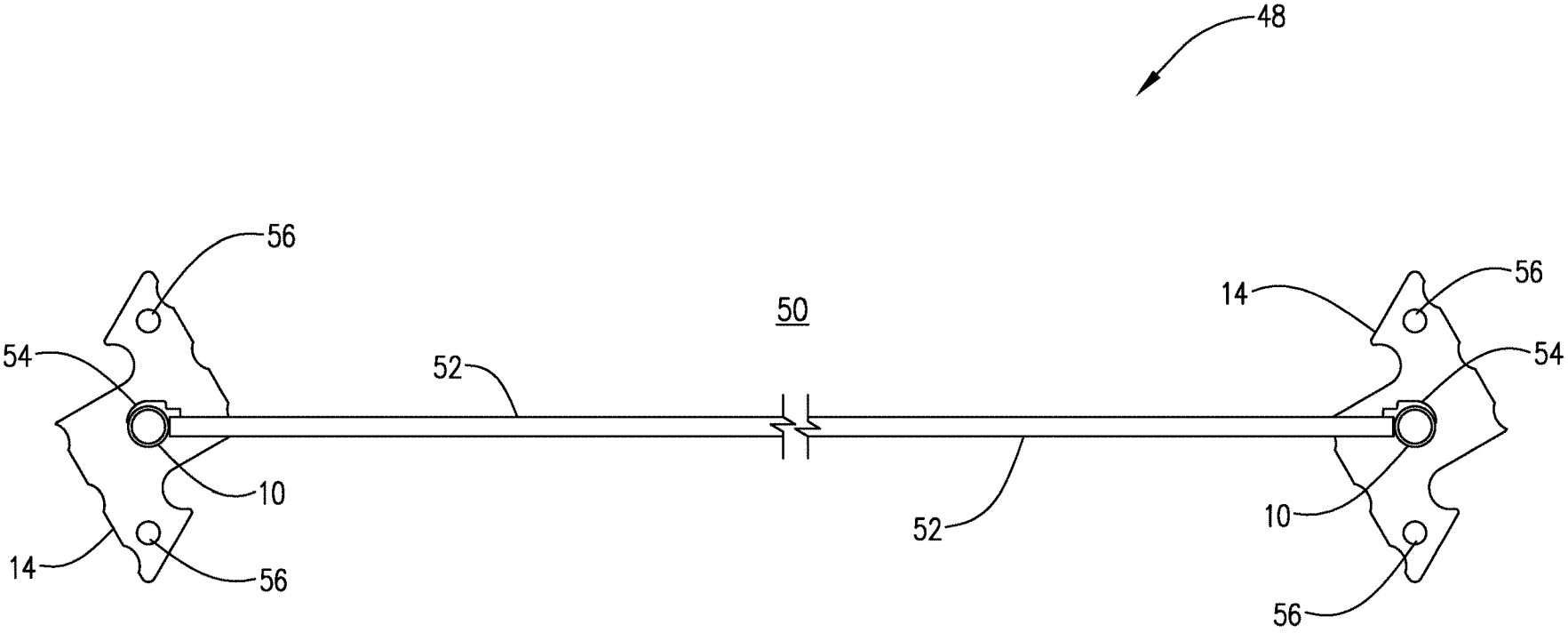
FIG. 10 is a top plan view of the barrier of FIG. 9, taken along line 10-10.
Figure 11:
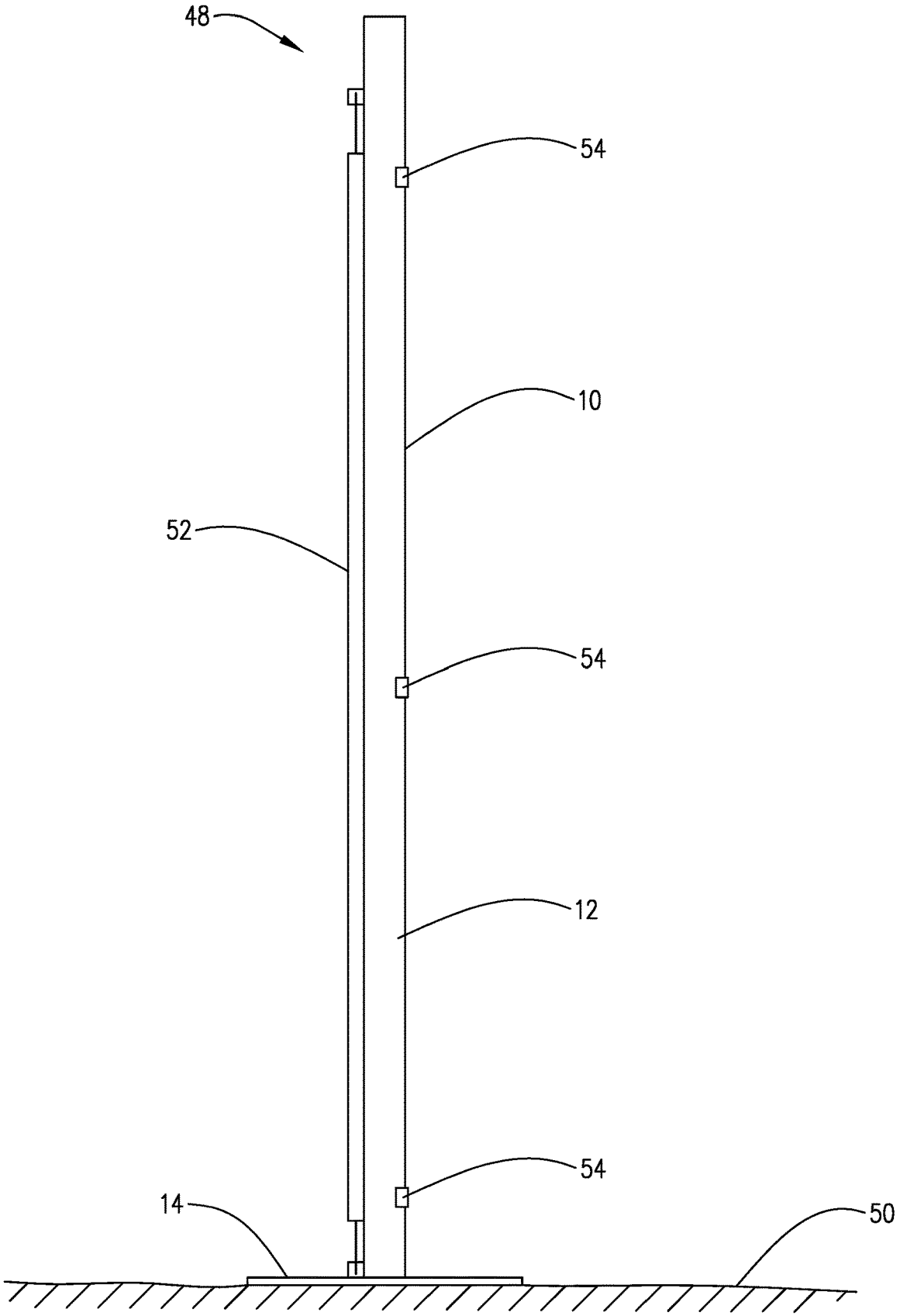
FIG. 11 is a side elevation view of the barrier of FIG. 10, taken along line 11-11.

A barrier 48, such as a temporary fence, is formed by positioning a plurality of posts 10 atop a terrain 50. The terrain 50 may comprise the ground or some other substrate, such as flooring or a body of concrete. The posts 10, which are preferably identical, are supported vertically on the terrain 50 at their respective bases 14. Two posts 10 of such a barrier 48 are shown in FIGS. 9-11.

Figure 12:
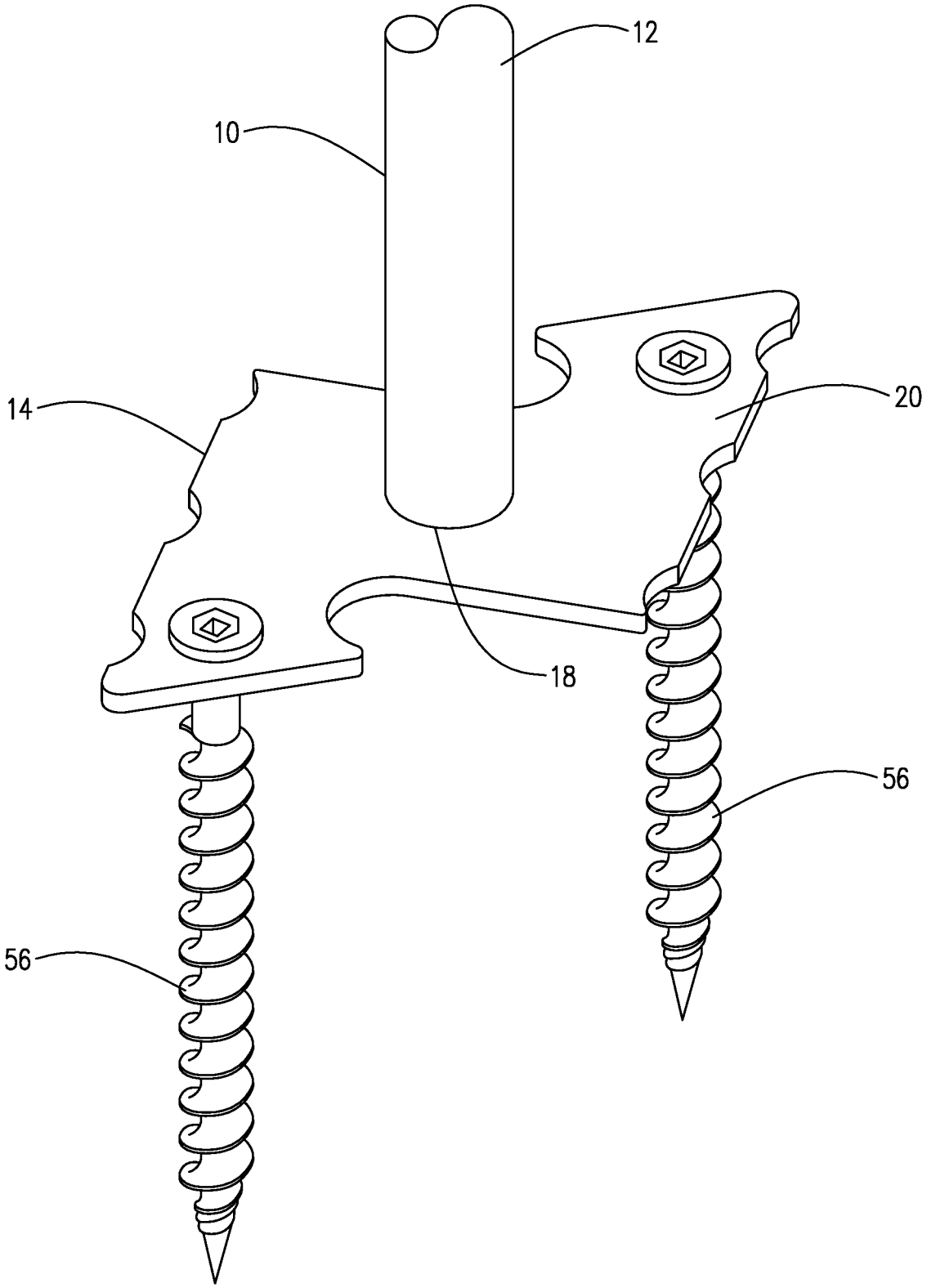
FIG. 12 is a perspective view showing how the base of the post of FIG. 1 is assembled with anchors to form a barrier.

A sheet 52 of infill material is supported by each pair of adjacent posts 10 forming the barrier 48. The sheet 52 may be entirely flat, or may be partially flat with one or more V-folds. The infill material may comprise a fencing fabric, such as chain link. Connectors 54 connect each sheet 52 to the shafts 12 of its associated posts 10. If the terrain 50 comprises soil, the base 14 of one ore more of the posts 10 may be secured to the terrain 50 with anchors 56, shown in FIG. 12. The anchors 56 are inserted through anchor openings 46 in the base 14, and driven into the soil.

Figure 14:
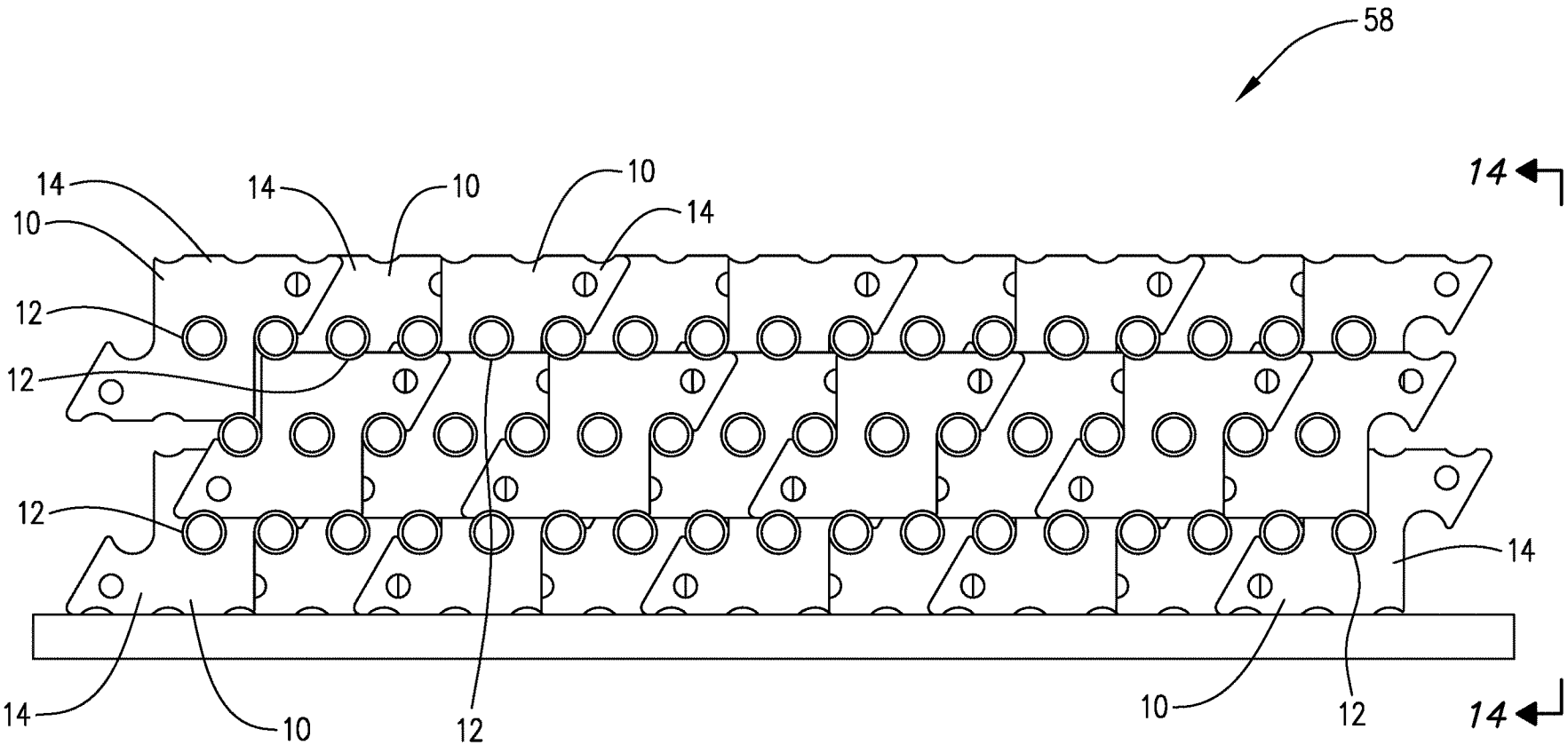
FIG. 14 is a side elevation view of the framework of FIG. 13.
Figure 14:
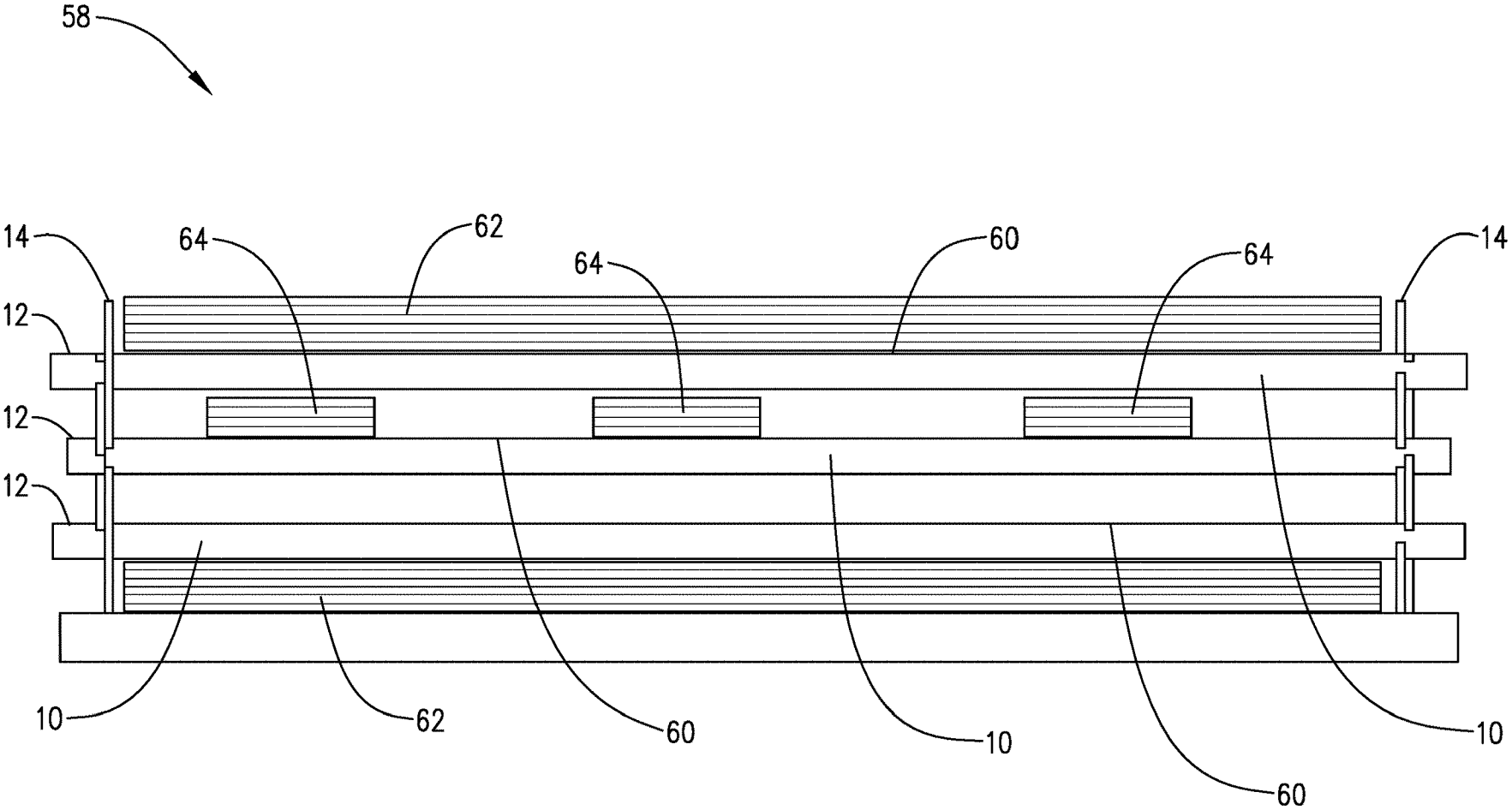

In instances where the barrier 48 must be disassembled for purposes of storage or transport, the bases 14 facilitate formation of a compact, but easily accessible, framework 58, shown in FIGS. 13 and 14. The side-by-side shafts 12 of the assembled posts form at least one, and preferably a plurality of shelves 60. The shelves 60 of the framework may be used to store flat components of the barrier 48, such as stacks 62 of sheets of infill material, and stacks 64 of ground mats.

The construction of a framework 58 of posts 10 is shown in FIGS. 15-21, which illustrate steps in the assembly of a framework of the type shown in FIGS. 13 and 14. In the initial stages of assembly, a first plurality of posts are arranged in side-by-side relationship such that the base 14 of each post receives the upper end 16 of the adjacent post 10 in one of its scoops 36. In subsequent stages, a second plurality of posts, different from the first plurality of posts, is added to the assembly. Posts of the second plurality are arranged in side-by-side relationship such that the base 14 of each post receives the upper end 16 of the adjacent post in one of its scoops 36, and such that each post is cradled in a scallop 32 of the base 14 of one of the posts of the first plurality.

Figure 15:
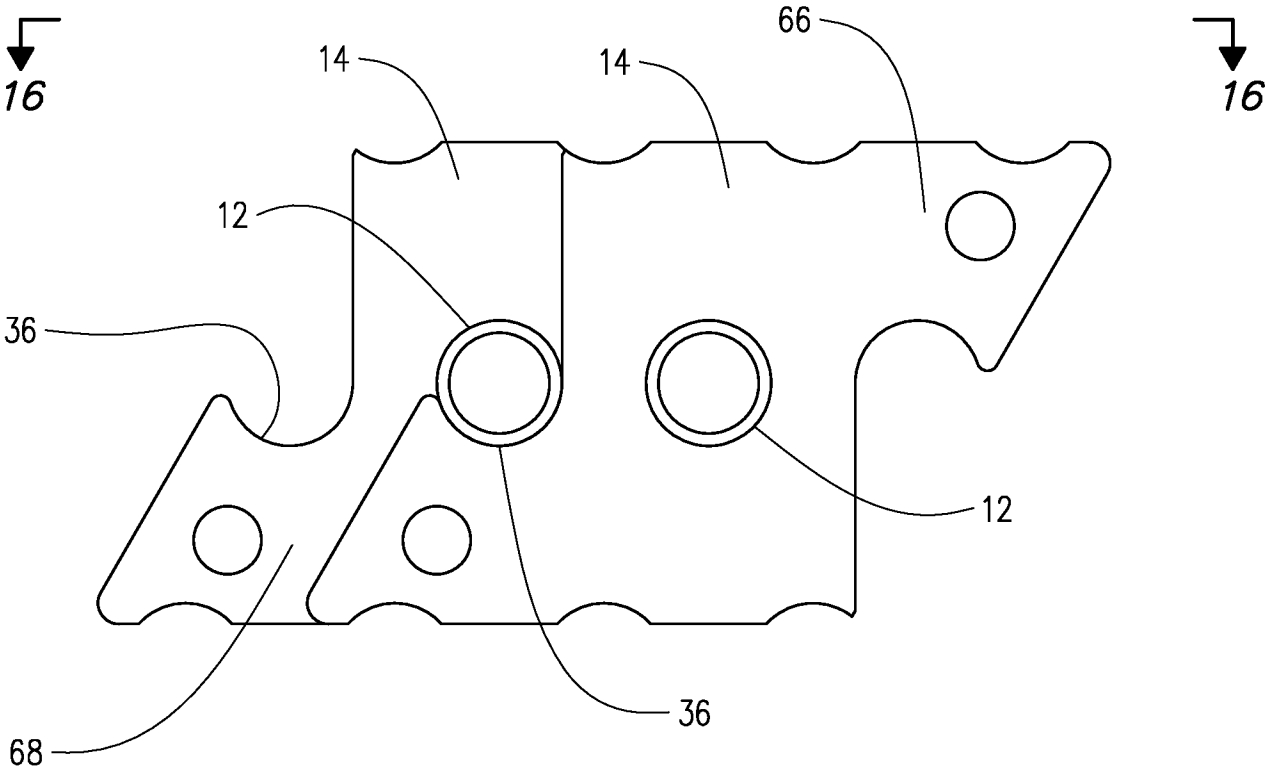
FIG. 15 is a front elevation view of two of the posts of FIG. 1, assembled into interlocking relationship.
Figure 1E:
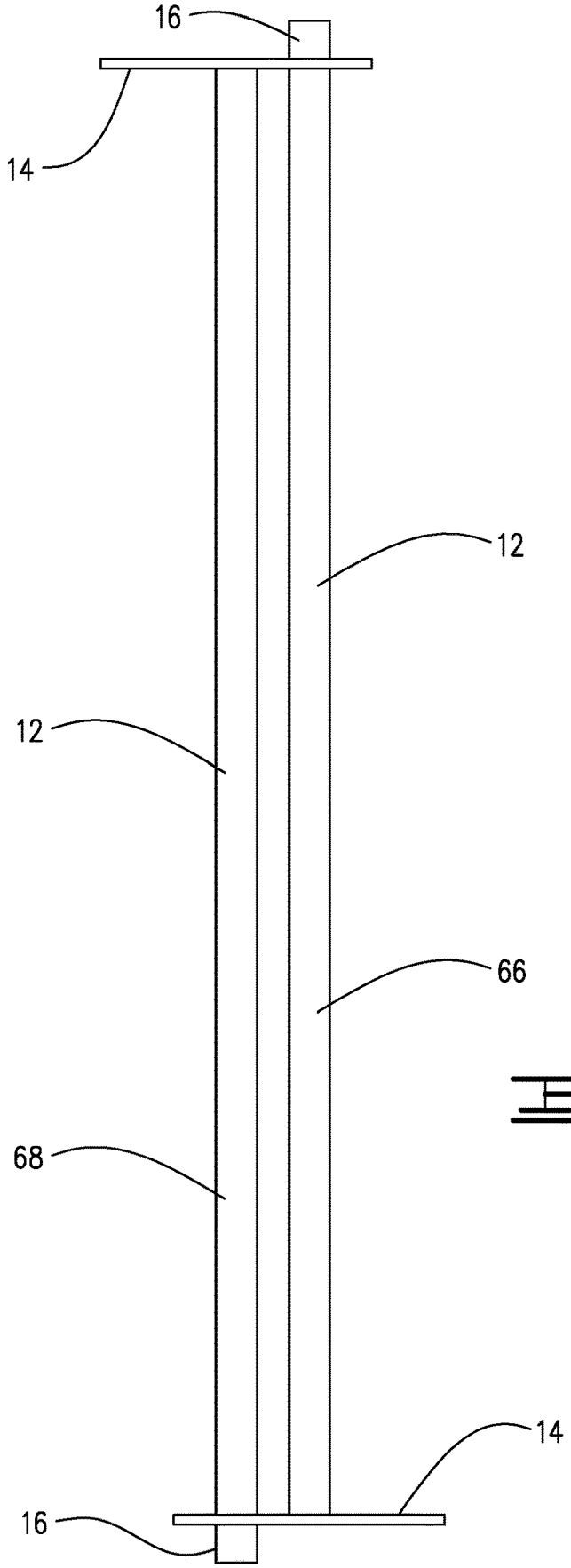
Figure 16:
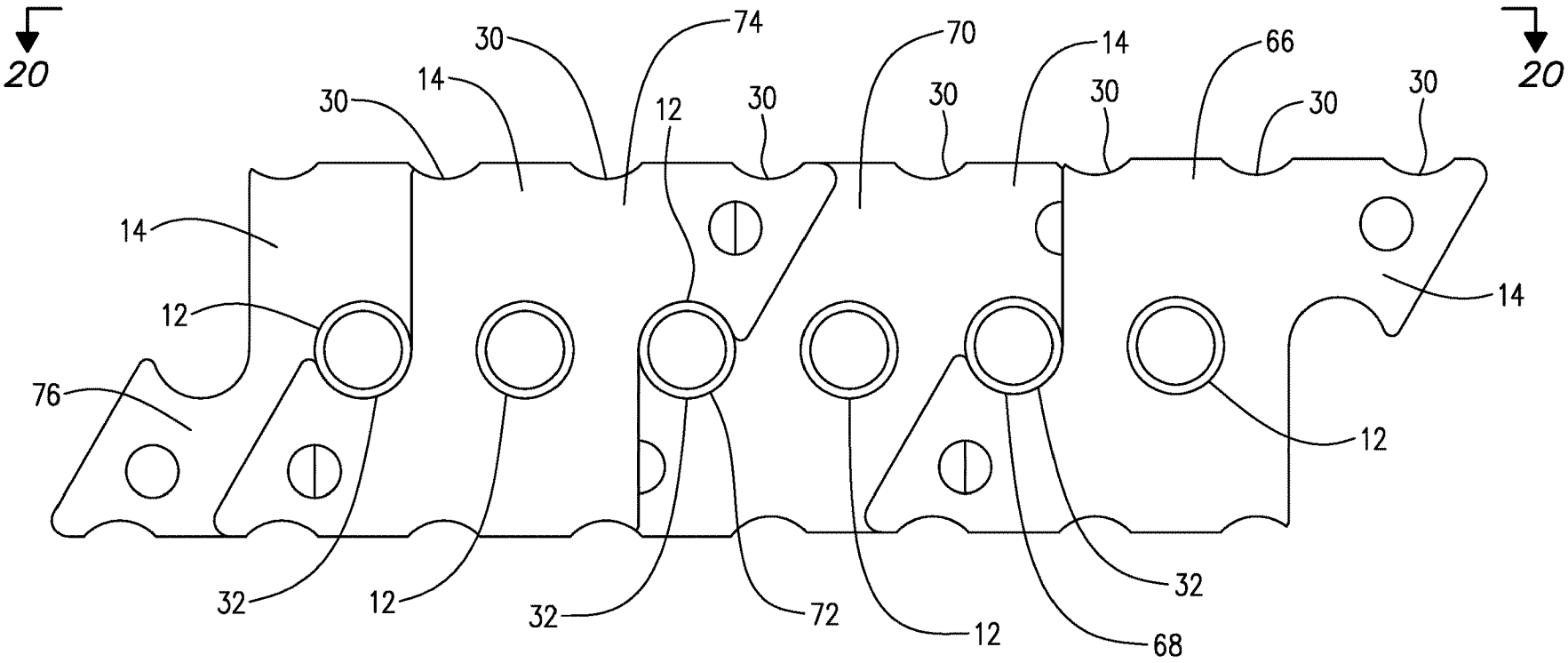
FIG. 16 is a top plan view of the assembly of FIG. 15, taken along line 16-16.

Included in the first plurality of posts are a first post 66 and a second post 68, shown in FIGS. 15 and 16. The posts 66 and 68 are arranged in side-by-side relationship such that the upper end 16 of one post rests in a scoop 36 of the base 14 of the other post. The posts 66 and 68 are thus interlocked at a lowermost level.

Figure 17:
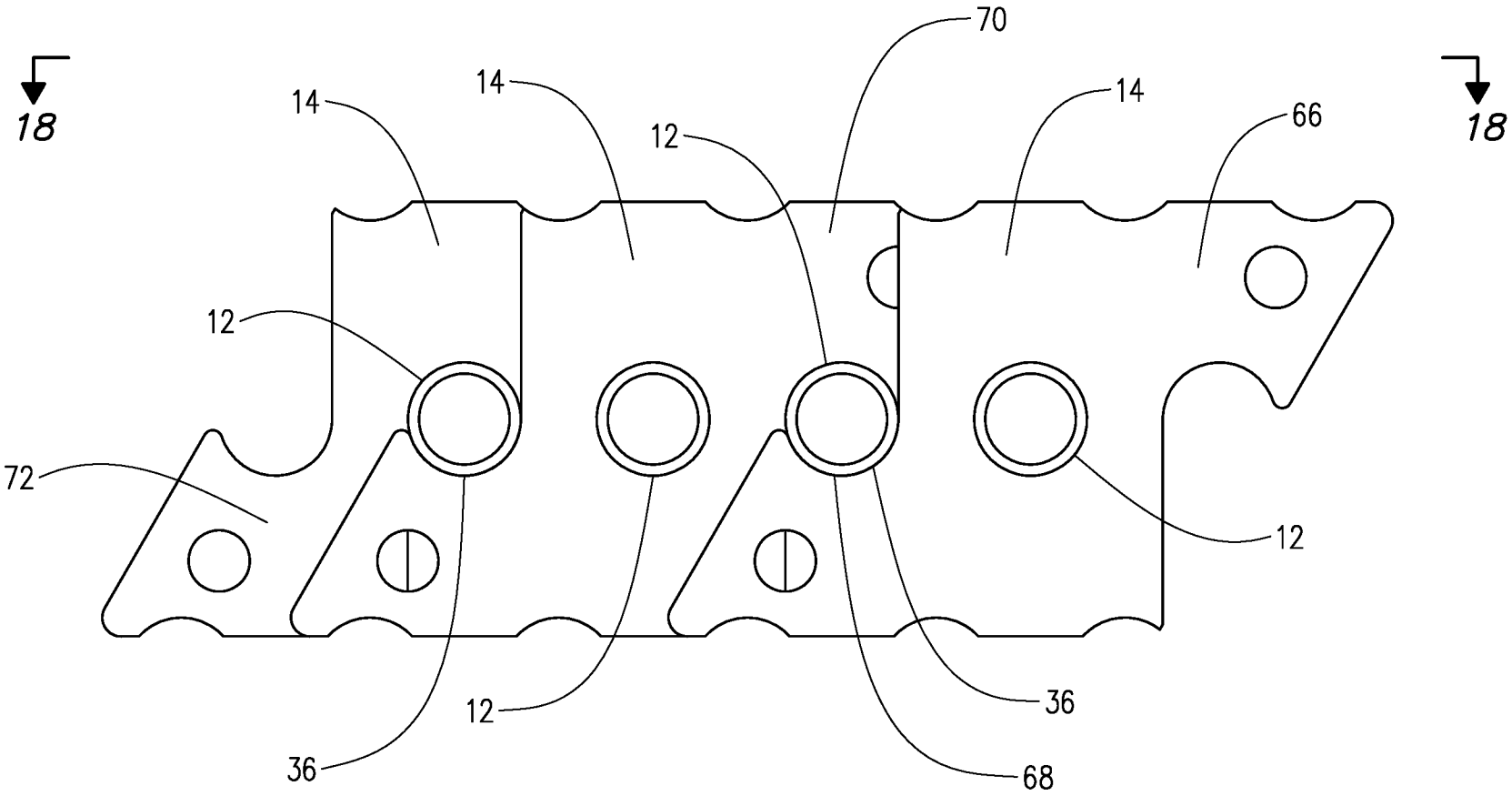
FIG. 17 is a front elevation view of four of the posts of FIG. 1, assembled into interlocking relationship. Two posts have been added on the lowermost level to the assembly of FIG. 15.
Figure 15:
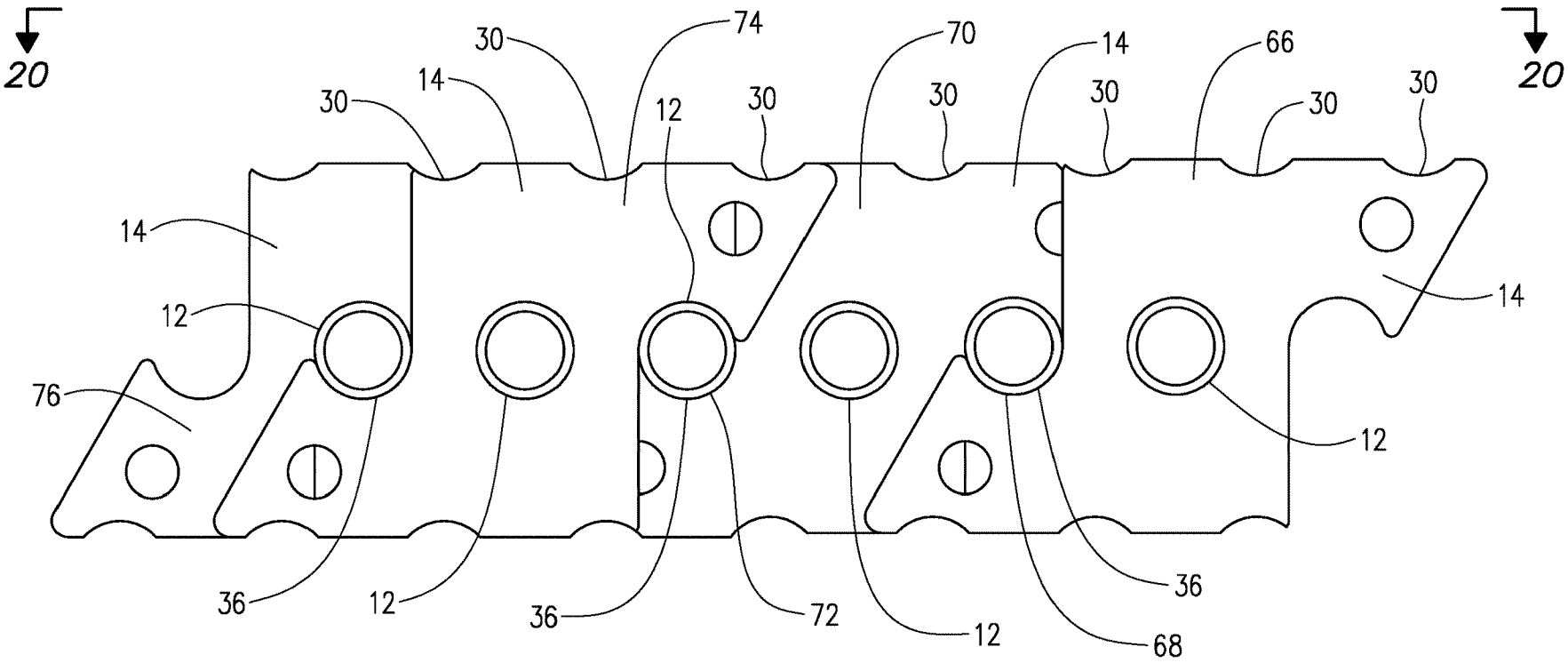

Also included in the first plurality of posts are a third post 70 and a fourth post 72, shown in FIGS. 17 and 18. In subsequent steps, the third post 70 is placed side-by-side with the second post 68, on the side opposite the first post 66. The third post 70 is positioned such that its upper end 16 rests in a scoop 36 of the base 14 of the second post 68.

The fourth post 72 is next placed side-by-side with the third post 70, on the side opposite the second post 68. The fourth post 72 is positioned such that its upper end 16 rests in a scoop 36 of the base 14 of the third post 70. The first, second, third and fourth posts 66, 68, 70 and 72 are thus interlocked at the same lowermost level.

Figure 20:
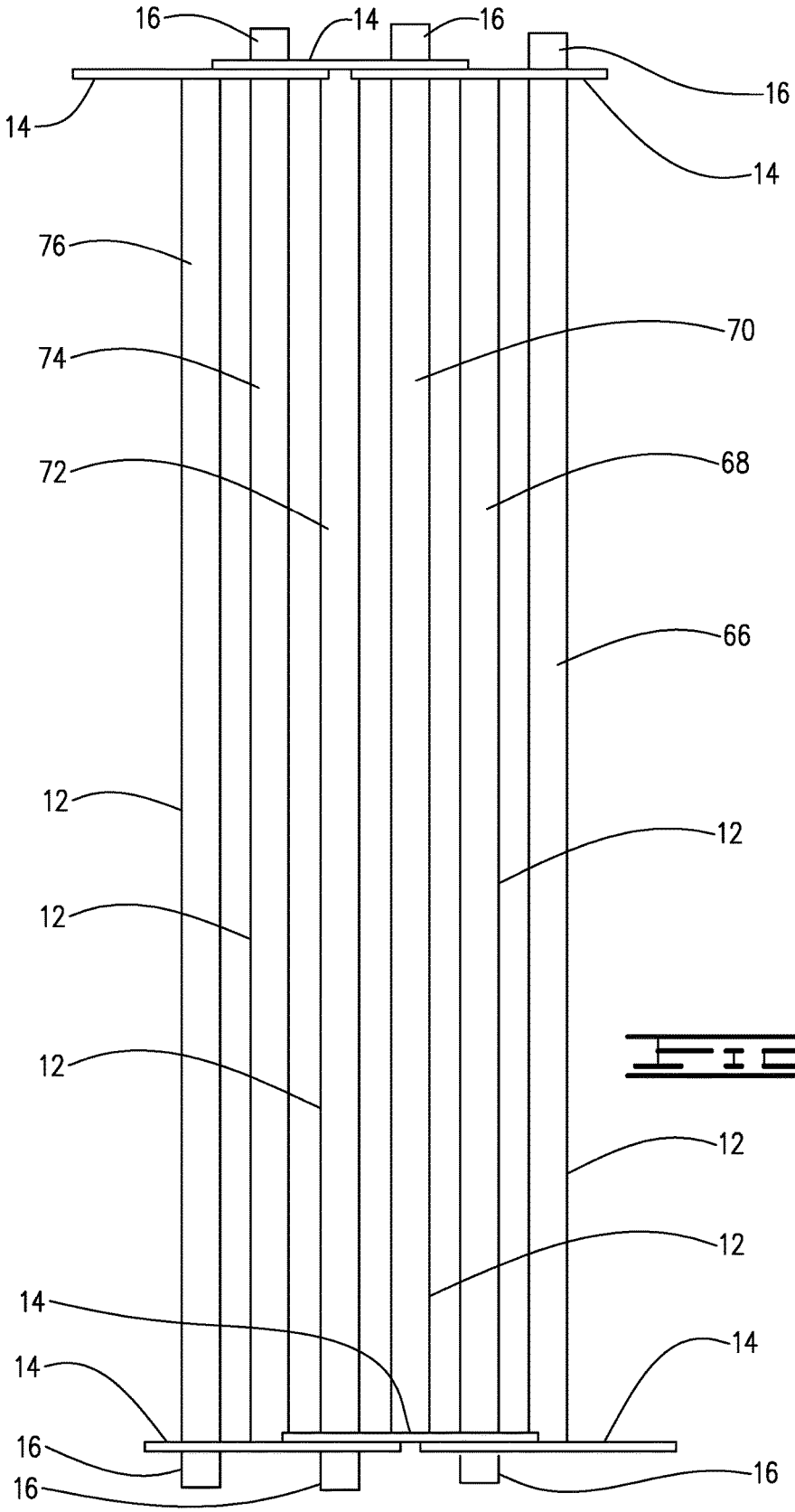
FIG. 20 is a top plan view of the assembly of FIG. 19, taken along line 20-20.
Figure 21:
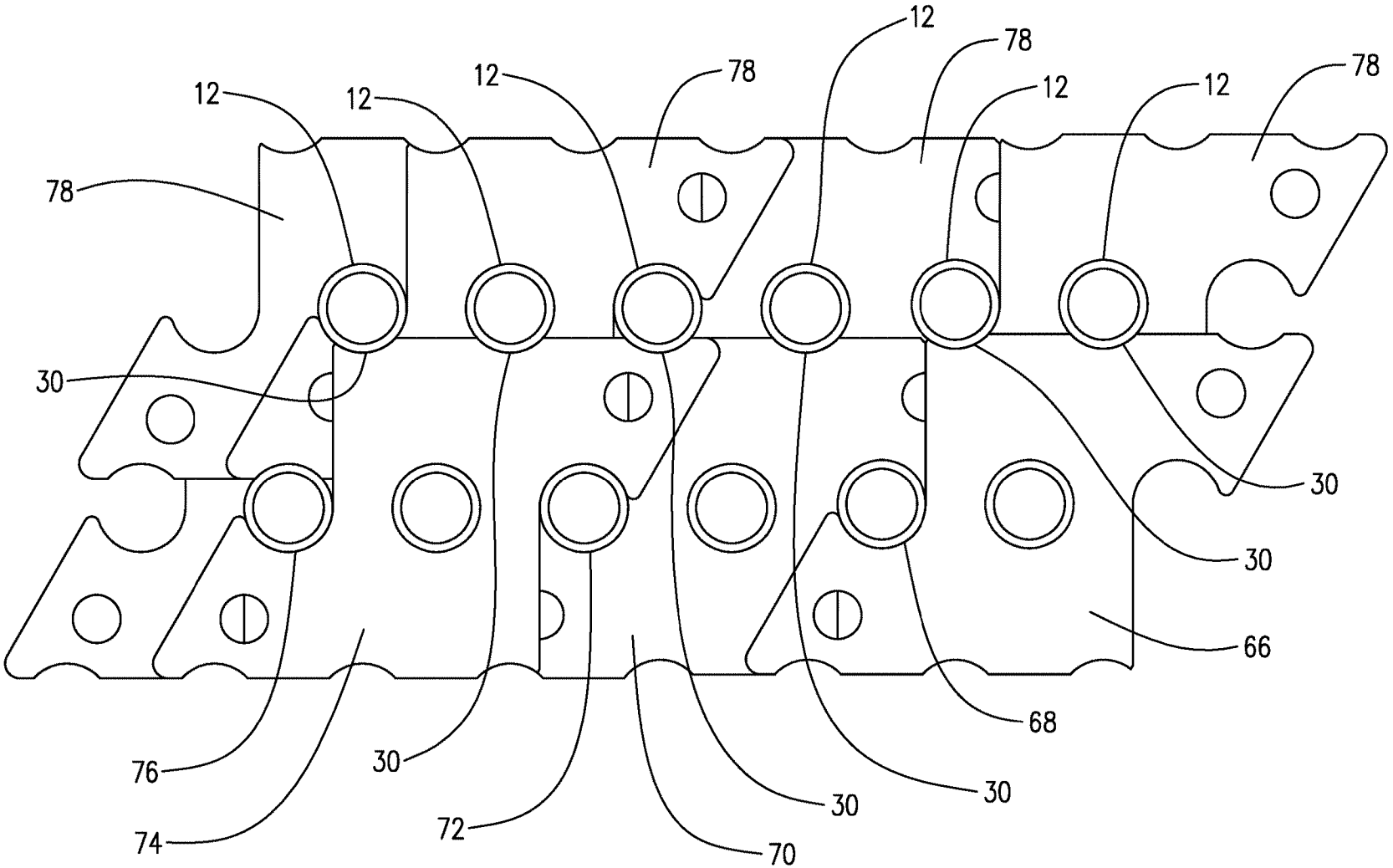
FIG. 21 is a front elevation view of ten of the posts of FIG. 1, assembled into interlocking relationship. Four posts have been added on a second level to the assembly of FIG. 19.
Figure 22:
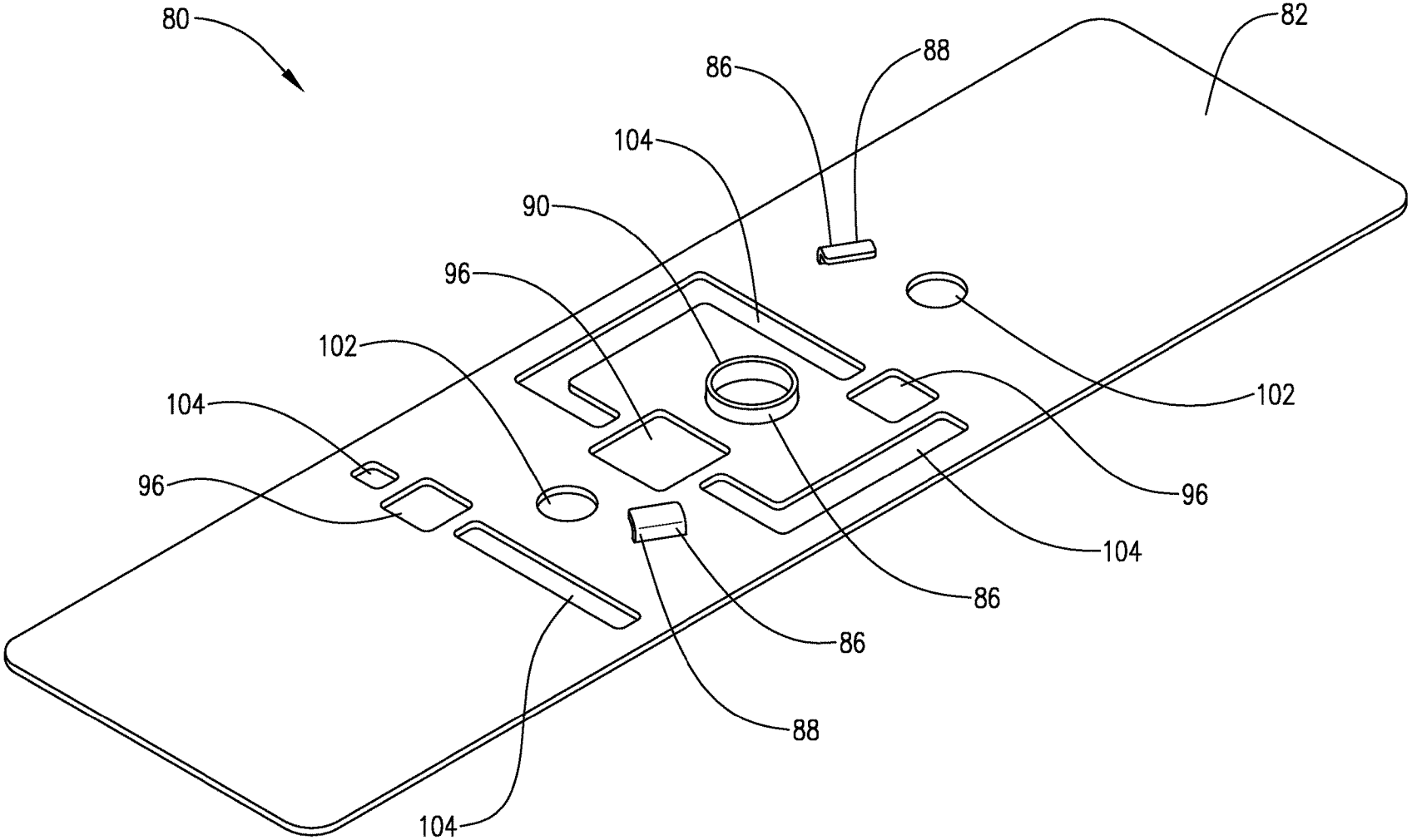
FIG. 22 is a perspective view of a ground mat.
Figure 25:
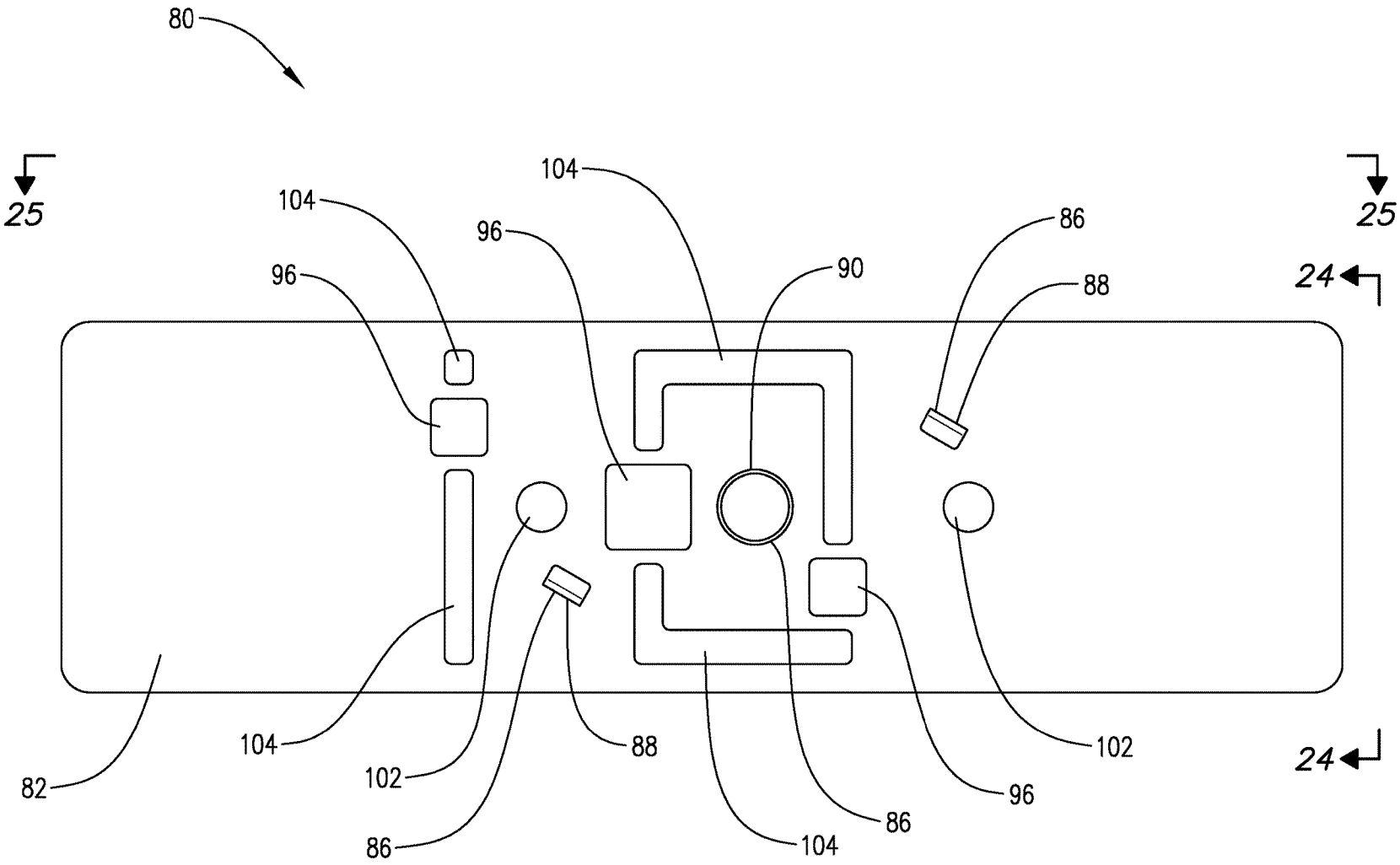
FIG. 25 is a side elevation view of the ground mat of FIG. 23, taken along line 25-25.
Figure 4:
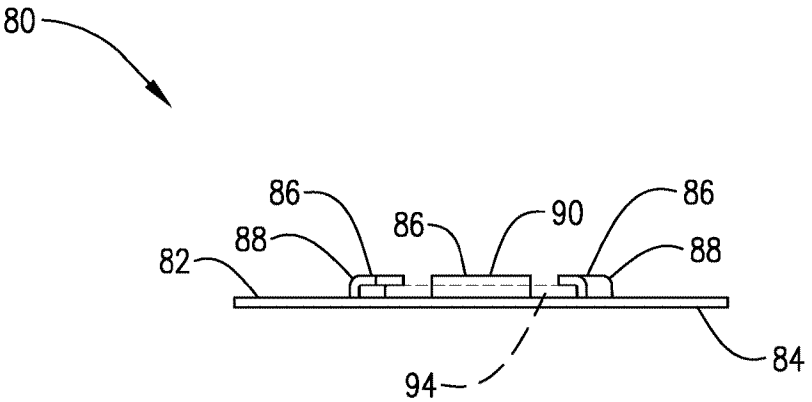
Figure 5:
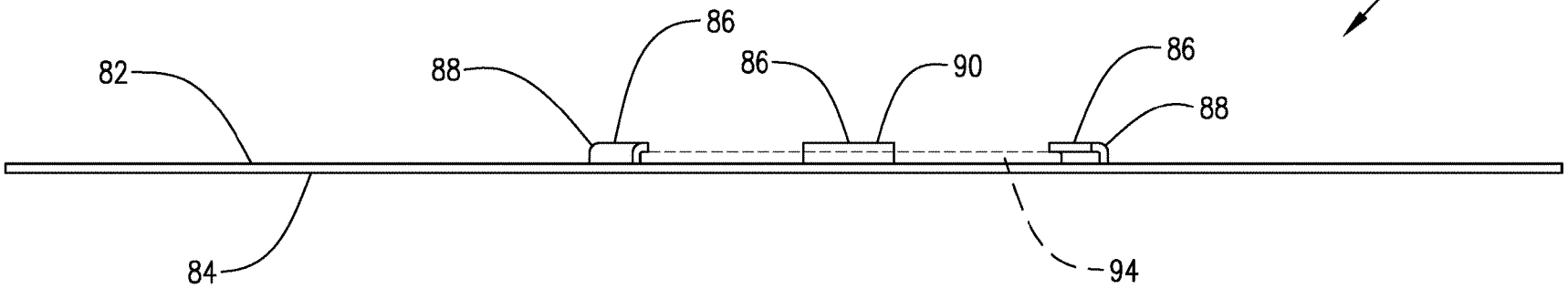
Figure 25:
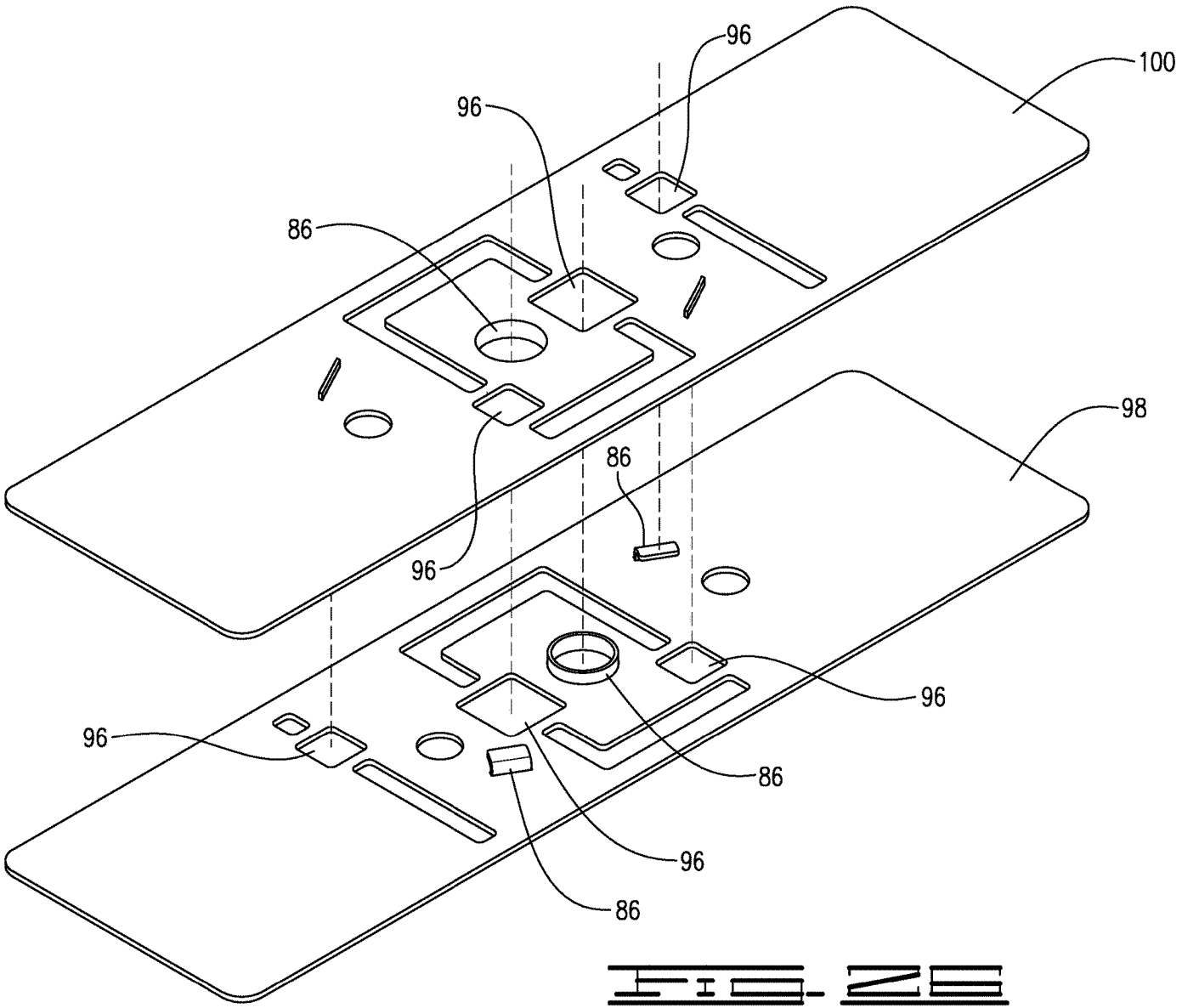

Also included in the first plurality of posts are a fifth post 74 and a sixth post 76, shown in FIGS. 19 and 20. In subsequent steps, the posts 74 and 76 are added to the assembly in like manner to that described with reference to the posts 66, 68, 70 and 72. The six posts 66, 68, 70, 72, 74 and 76 are thus interlocked at the same lowermost level. The first plurality of posts may include additional posts added to the lowermost level in like manner. These posts cooperate to form the lowermost shelf 60 of the framework 58.

In the next stage of construction of the framework 58, another level of posts 10 is built atop the lowermost level. This stage may begin after construction of the lowermost level is complete, or may begin while construction of the lowermost level remains in progress. As shown in FIG. 20, a second plurality of additional posts 78 is placed such that their scallops 32 rest atop the shafts 12 of posts in the lowermost level. Each additional post 78 is interlocked with an adjacent post in the same manner described with reference to the posts 66 and 68. The interlocked posts 78 cooperate to form the next highest shelf 60 of the framework 58.

Additional posts may be added to each level, and additional levels added to the assembly until a framework 58 of the desired size and shape is formed. The foregoing assembly process may be reversed whenever it is desired to place the posts 10 of a framework 58 into service in a barrier 48.

A ground mat 80, shown in FIGS. 22-25 may be used to increase the effective surface area of the base 14. An increase in effective surface area can enhance the stability of the post 10, and any barrier of which it is part. Such enhanced stability can be especially desirable when a barrier is installed on soft or muddy ground, or is exposed to nearby moving crowds.

The ground mat 80 is a flat member, preferably of substantially rectangular shape, having a flat upper side 82 and an opposed and flat lower side 84. Preferably, the surface area of the ground mat 80 is greater than that of the base 14. Several elevated projecting features 86 are formed on the upper side 82 of the ground mat 80, including dual hooks 88 and a boss 90.

The hooks 88 are concave structures that bound opposed edges 92 of a slotlike opening 94. Preferably, the separation distance of the hooks 88 is slightly less than the separation distance of the second sides 34 of the base 14, so that the base 14 is closely, but clearingly extendable within the opening 94. As best shown in FIG. 24, the hooks 88 do not fully enclose the opening 94.

The boss 90, which is preferably situated at the centroid of the upper side 82, is shaped and sized to be closely, but clearingly received through the shaft opening 44 in the base 14 and within the open lower end 18 of the shaft 12. The boss 90 may be hollow. In one embodiment, the boss 90 has a cylindrical external shape.

The ground mat 80 is preferably characterized by a plurality of projection openings 96 that are spaced from the edges of the ground mat 80. Each projection opening 96 is shaped and sized to receive a corresponding one of the projecting features 86. The projection openings 96 are arranged in a pattern that, if inverted, registers with the pattern formed by at least some, and preferably all, of the projecting features 86.

Figure 27:
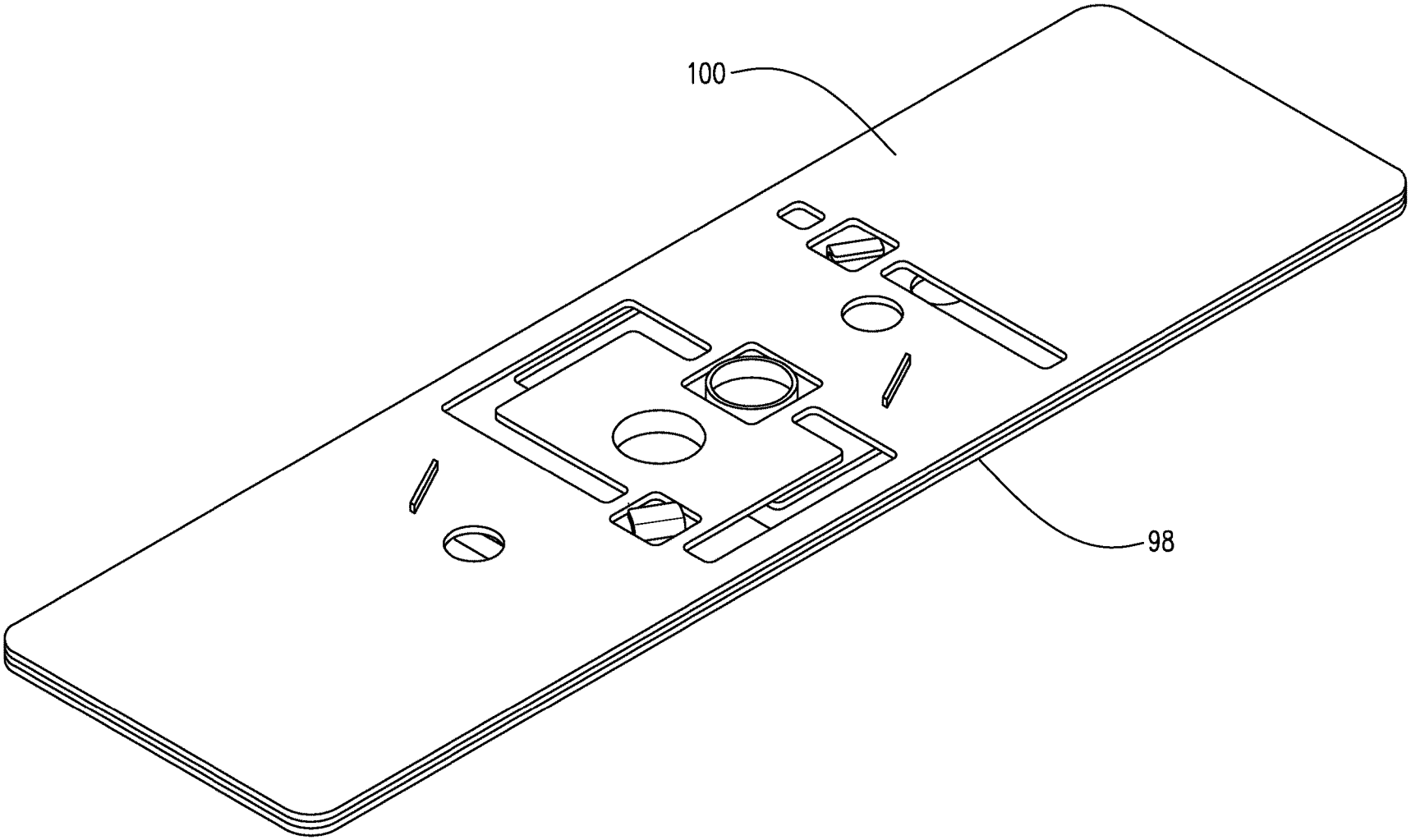
FIG. 27 is a perspective view showing two nested ground mats.

FIG. 26 shows a first ground mat 98 and an identical and overlying second ground mat 100. The second ground mat 100 is inverted relative to the first ground mat 98. Because of the pattern, size and shape of the projection openings 96 of the second ground mat 100, each projecting feature 86 of the first ground mat 98 is received through a corresponding one of the projection openings 96 in the second ground mat 100, as shown in FIG. 27. Likewise, each projecting feature 86 of the second ground mat 100 is received through a corresponding one of the projection openings 96 in the first ground mat 98.

The registry between the openings 96 and features 86 permits compact and secure nesting of pairs of ground mats 80. Such nesting facilitates stacking and storage of ground mats 80 when not in use.

The ground mat 80 is preferably further characterized by a pair of spaced anchor openings 102 and one or more utility openings 104. The anchor openings 102 register with corresponding anchor openings 46 formed in the base 14. The utility openings 104 may receive a ligature that binds stacked ground mats 80 together, or may be used as an alternative or supplement to the anchor openings 102 when securing a ground mat 80 to a terrain. In the embodiment shown in the Figures, one utility opening 104 is rectilinear and formed in two parts while two other utility openings 104 are L-shaped.

The ground mat 80 is preferably formed from a strong and durable material, such as steel. Because the ground mat 80 may be used outdoors, the steel used to form it is preferably pre-galvanized, in order to enhance its resistance to corrosion. After a ground mat has been fabricated, a polyester powder coating may also be applied, to further enhance corrosion resistance.

In the same embodiment described with reference to the post 10, the ground mat 80 has a rectangular shape with a major side of 45 inches, a minor side of 13 inches, and a thickness of 0.25 inches. The maximum height of the projecting features 86 above the upper side 82 is 0.82 inches. The boss 90 is an annulus with a thickness of 0.083 inches, and an external radius of 1.135 inches. Each hook 88 is an L-shaped member with a length of 1.5 inches and a thickness of 0.1875 inches. Each leg of the "L" has an outside width of 0.82 inches. The projection opening 96 that receives the boss 90 is a square with a side of 3 inches. The projection openings 96 that receive the hooks 88 are each preferably a square with a side of 2 inches. Each anchor opening 102 is circular with a radius of 0.875 inches.

Figure 28:
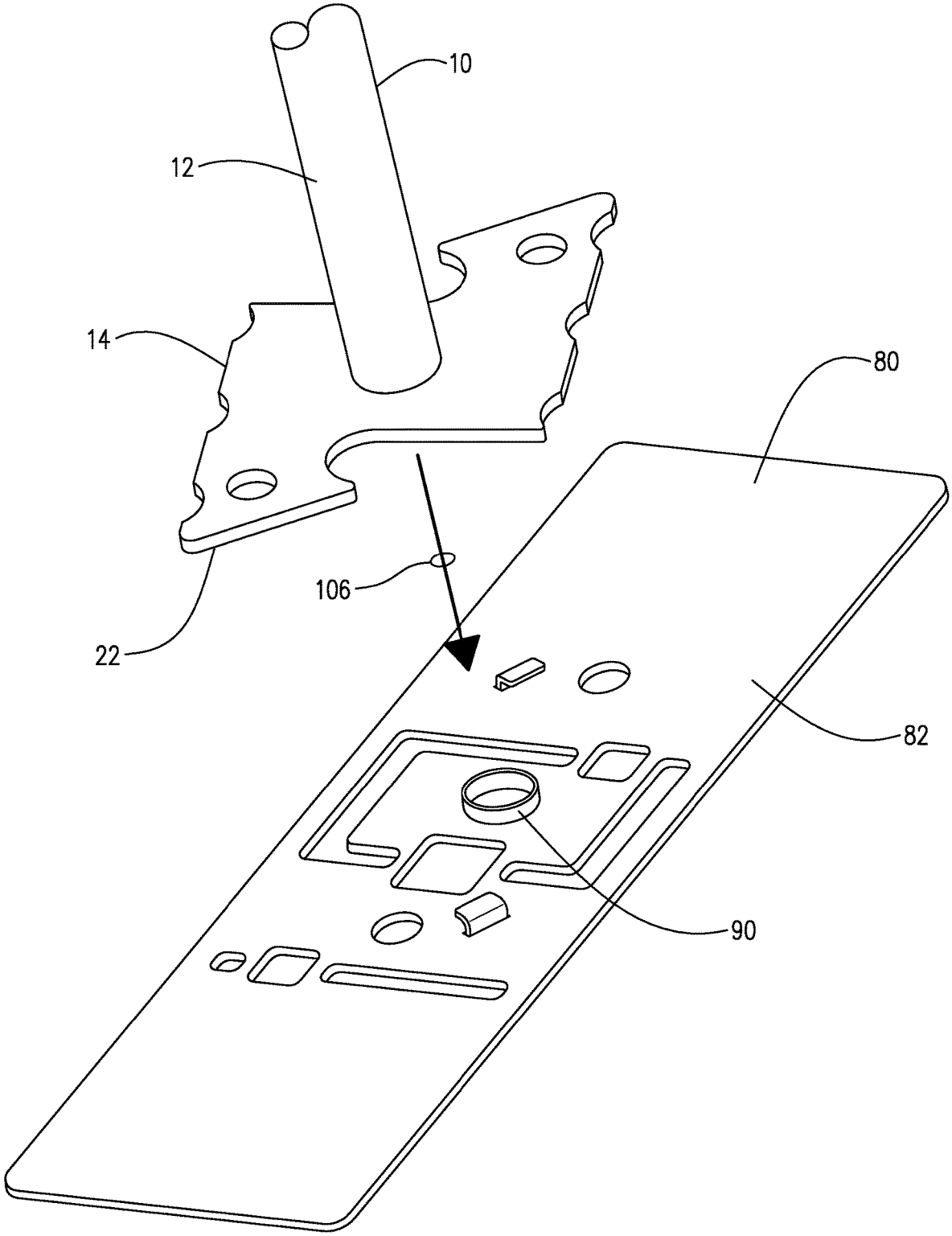
Figure 25:
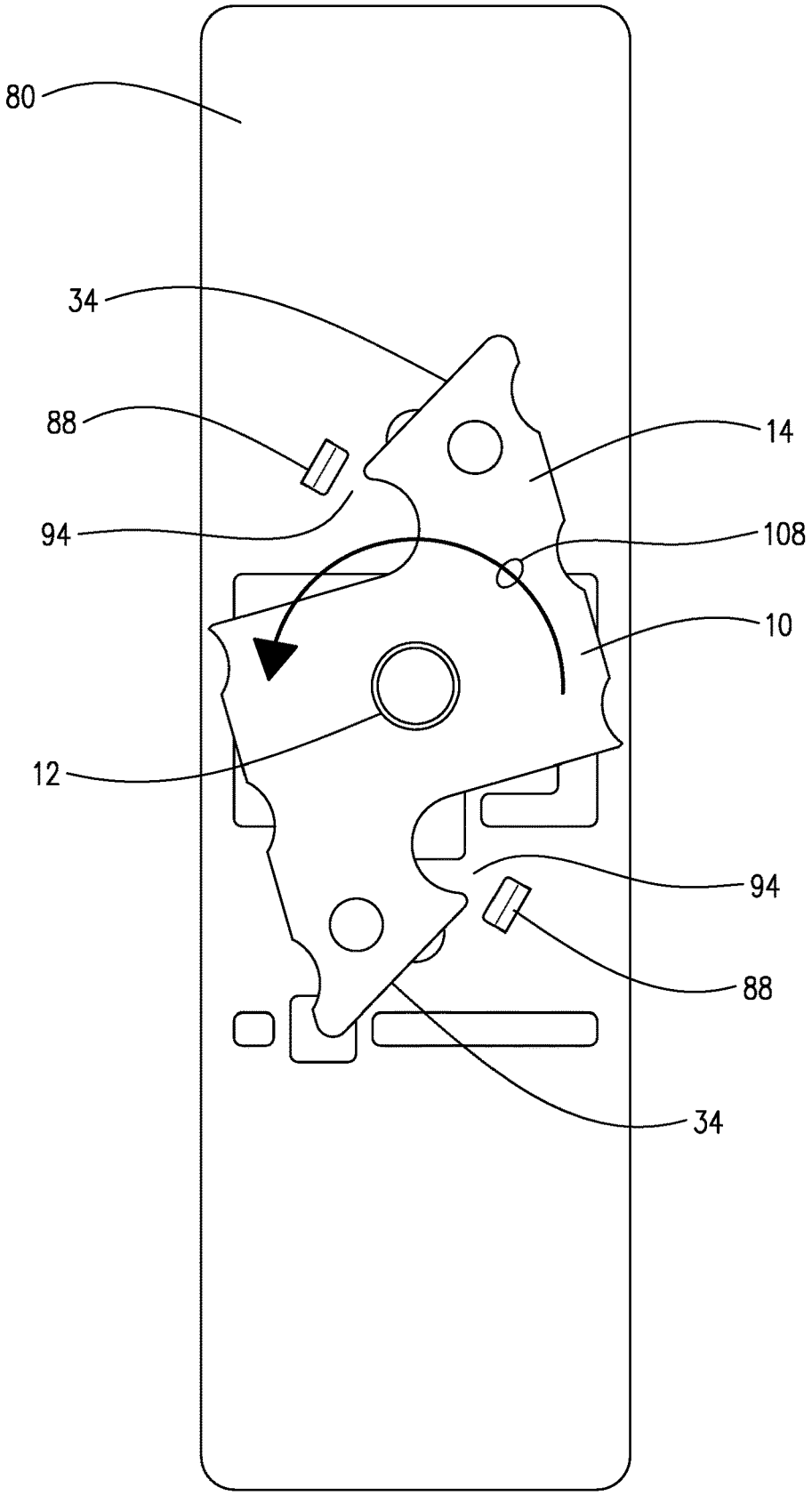
Figure 30:
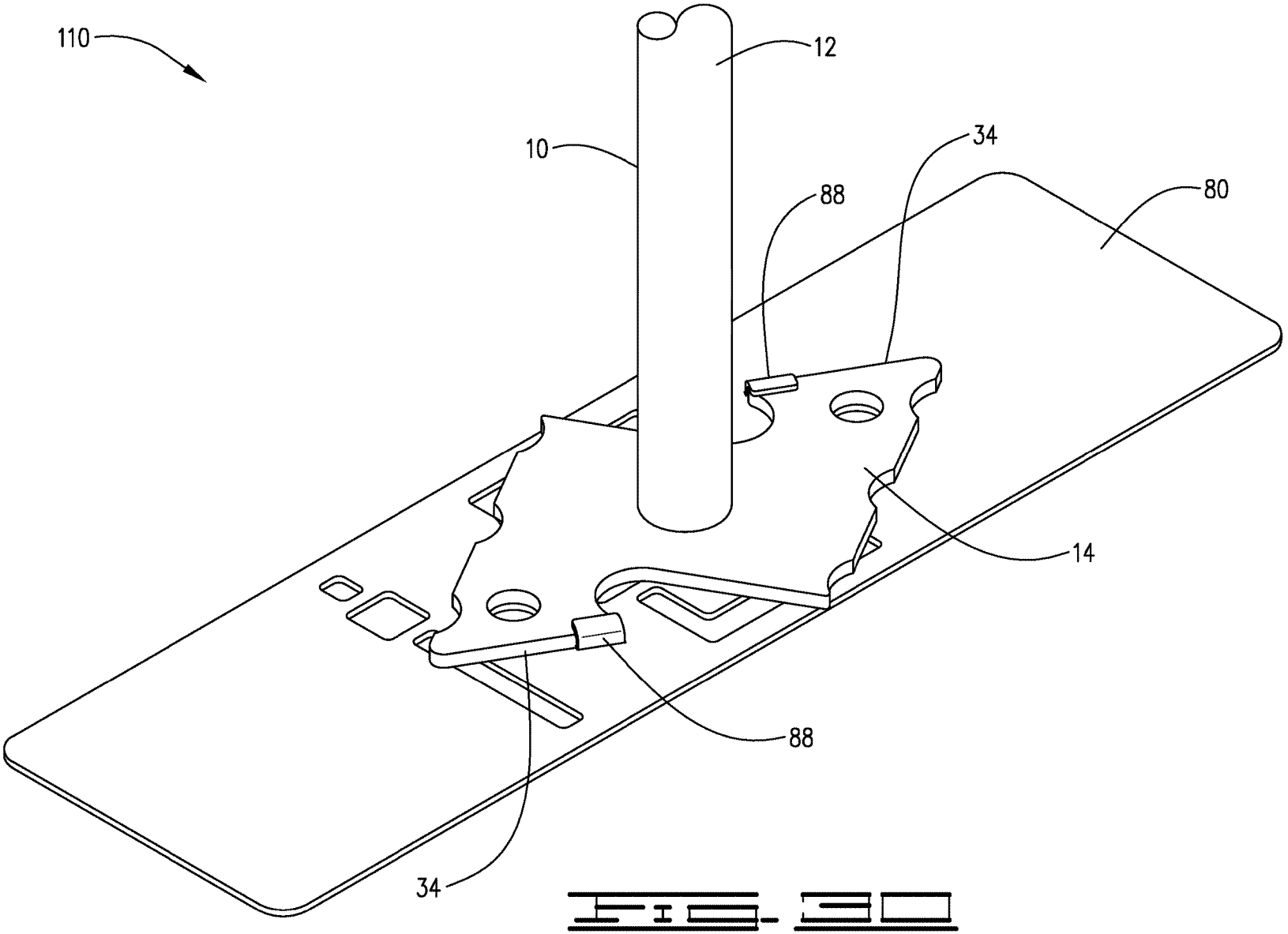
FIG. 30 shows the lower portion of the post of FIG. 1 assembled with the ground mat of FIG. 22.

A post 10 is assembled with a ground mat 80 by placing the post 10 above the ground mat's upper side 82. The post 10 is moved in the direction of arrow 106, shown in FIG. 28, until the boss 90 enters the shaft 12, and the lower side 22 of the base 14 engages the upper side 82 of the ground mat 80. Once so engaged, the post 10 is rotated in the direction of the arrow 108, shown in FIG. 29. As the base 14 rotates, its second sides 34 become aligned with, and are fully received within, the opening 94, thereby causing the base 14 and hooks 88 to interlock. The resulting post-ground mat assembly 110 is shown in FIG. 30.

Figure 31:
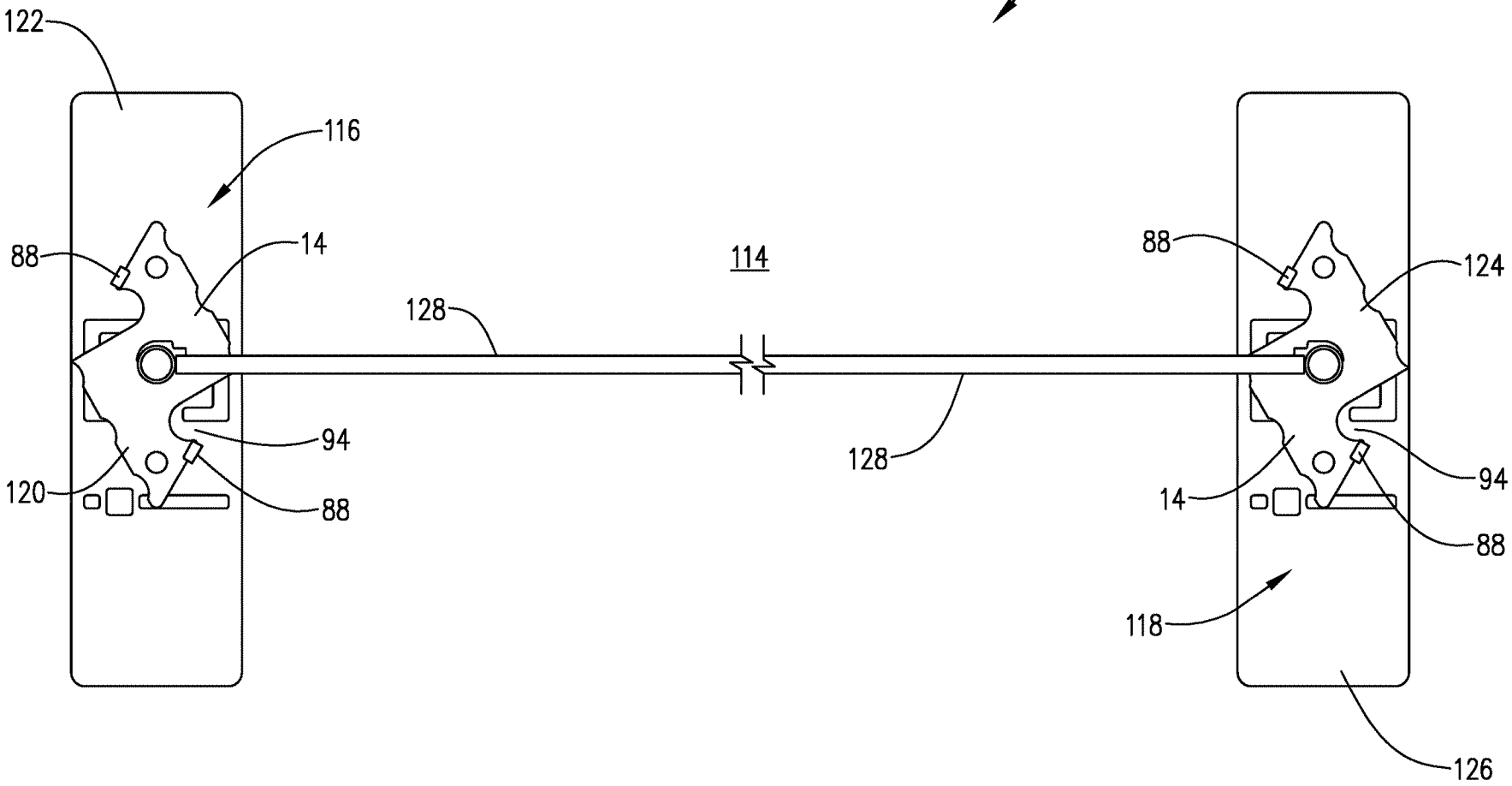
FIG. 31 is a top plan view of a barrier, similar to FIG. 11, but differing in that the post bases have been assembled with ground mats.

A plurality of post-ground mat assemblies 110, preferably identical, are formed into a barrier 112 on a terrain 114 in the same manner described with reference to the posts 10 in FIGS. 9-11. A first post-ground mat assembly 116 and a second post-ground mat assembly 118 of such a barrier 112 are shown in FIG. 31. The first post-ground mat assembly 116 comprises a first post 120 and a first ground mat 122. The second post-ground mat assembly 118 comprises a second post 124 and a first ground mat 126.

The lower sides of the first and second ground mats 124 and 122 engage the terrain 114. The base 14 of each of the first and second posts 120 and 124 extends within the opening 94 between the hooks 88 of a corresponding one of the first and second ground mats 126 and 108. A sheet 128 of infill material is supported between the first and second posts 120 and 124. If anchors are used to secure the barrier 112 to the terrain 114, each anchor passes through, not just the anchor opening 46 in the base 14, but through the underlying and aligned anchor opening 102 in the ground mat 80 as well.

A barrier 48 or 112 may be assembled from components of a kit. Such a kit may comprise a plurality of posts 10 and a plurality of sheets 52 of infill material. Optionally, such a kit may include a plurality of ground mats 80. Another kit may comprise a plurality of posts 10 and a plurality of ground mats 80. Optionally, such a kit may include a plurality of sheets 52 of infill material. Other components of the barriers 48 and 112, such as connectors 54 and anchors 56, may be added to either kit.

Unless otherwise stated herein, any of the various parts, elements, steps and procedures that have been described should be regarded as optional, rather than as essential. Changes may be made in the construction, operation and arrangement of these parts, elements, steps and procedures without departing from the spirit and scope of the invention as described in the following claims.

The invention claimed is:

1. A post, comprising:

an elongate and rectilinear shaft having opposed upper and lower ends; and a flat base supported by the shaft at its lower end and extending in orthogonal relationship to the shaft, the base having a centroid and an external profile, the external profile comprising:

two sets of aligned and concave scallops, the sets having point symmetry relative to the centroid; and two concave scoops, the scoops having point symmetry relative to the centroid, the scoops being situated on opposite sides of an imaginary line extending through the centroid, with each scoop opening toward that line.

2. The post of claim 1 in which the entirety of the external profile has point symmetry relative to the centroid.

3. The post of claim 1 in which the number of scallops in each set is three.

4. The post of claim 1 in which each scallop in a set has an arcuate shape.

5. The post of claim 1 in which each scoop has an arcuate shape.

6. The post of claim 1 in which the external profile further comprises:

a pair of spaced, parallel, rectilinear and longitudinally offset sides, one of the said sets of scallops being formed in each of the said sides.

7. The post of claim 6 in which each scoop has a center of curvature, and in which a line interconnecting the centers of curvature extends in parallel relationship to each of the sides.

8. The post of claim 7 in which the line interconnecting the centers of curvature extends between the sides.

9. The post of claim 6 in which each scoop has a center of curvature, and in which a line interconnecting the centers of curvature extends between the sides.

10. The post of claim 1 in which the base has an opening within which the centroid is situated.

11. The post of claim 1 in which each scallop and each scoop is sized and shaped to cradle the shaft.

12. The post of claim 1 in which the shaft has a circular external profile, and in which each scallop and each scoop has an arcuate shape with a radius of curvature that substantially equals the radius of the shaft.

13. The post of claim 1 in which the external profile has the shape of a non-rectangular parallelogram from which the said scallops and the said scoops have been excised.

14. The post of claim 13 in which the parallelogram has sides of equal length.

15. A kit, comprising:

a plurality of the posts of claim 1; and a plurality of sheets of infill material, each sheet supportable between an adjacent pair of said posts.

16. A framework, comprising:

a plurality of the posts of claim 1 arranged in side-by-side relationship such that the base of each post receives the upper end of an adjacent post in one of its scoops.

17. A framework, comprising:

a first plurality of the posts of claim 1 arranged in side-by-side relationship such that the base of each post receives the upper end of an adjacent post in one of its scoops; and a second plurality of the posts of claim 1, different from the first plurality of posts, arranged in side-by-side relationship such that the base of each post of the second plurality receives the upper end of an adjacent post in one of its scoops, and such that each post of the second plurality is cradled in a scallop of the base of one of the posts of the first plurality.

18. The framework of claim 17, further comprising:

a plurality of sheets of infill material supported by the shafts of the first plurality of posts.

19. A framework, comprising:

a plurality of posts, each post comprising:

an elongate and rectilinear shaft having opposed upper and lower ends;

and a flat base supported by the shaft at its lower end and extending in orthogonal relationship to the shaft, the base having a centroid and an external profile, the external profile comprising:

two sets of aligned and concave scallops, the sets having point symmetry relative to the centroid; and two concave scoops, the scoops having point symmetry relative to the centroid;

the plural posts being arranged in side-by-side relationship such that the base of each post receives the upper end of an adjacent post in one of its scoops.

20. A framework, comprising:

first and second pluralities of posts, each post of each plurality comprising:

an elongate and rectilinear shaft having opposed upper and lower ends; and a flat base supported by the shaft at its lower end and extending in orthogonal relationship to the shaft, the base having a centroid and an external profile, the external profile comprising:

two sets of aligned and concave scallops, the sets having point symmetry relative to the centroid; and two concave scoops, the scoops having point symmetry relative to the centroid;

the first plurality of posts being arranged in side-by-side relationship such that the base of each post receives the upper end of an adjacent post in one of its scoops; and the second plurality of posts being different from the first plurality of posts and arranged in side-by-side relationship such that the base of each post of the second plurality receives the upper end of an adjacent post in one of its scoops, and such that each post of the second plurality is cradled in a scallop of the base of one of the posts of the first plurality.

21. The framework of claim 20, further comprising:

a plurality of sheets of infill material supported by the shafts of the first plurality of posts.

22. A post, comprising:

an elongate and rectilinear shaft having opposed upper and lower ends; and a flat base supported by the shaft at its lower end and extending in orthogonal relationship to the shaft, the base having a centroid and an external profile, the external profile comprising:

two sets of aligned and concave scallops, the sets having point symmetry relative to the centroid; and two concave scoops, the scoops having point symmetry relative to the centroid;

each scallop and each scoop being sized and shaped to cradle the shaft.

23. A post, comprising:

an elongate and rectilinear shaft having opposed upper and lower ends and a circular external profile; and a flat base supported by the shaft at its lower end and extending in orthogonal relationship to the shaft, the base having a centroid and an external profile, the external profile comprising:

two sets of aligned and concave scallops, the sets having point symmetry relative to the centroid; and two concave scoops, the scoops having point symmetry relative to the centroid;

each scallop and each scoop having an arcuate shape with a radius of curvature that substantially equals the radius of the shaft.

* * * * *